US006736646B2

(12) United States Patent
Takahashi et al.

(10) Patent No.: US 6,736,646 B2
(45) Date of Patent: May 18, 2004

(54) ELECTROMAGNETIC INDUCTION-TYPE CONNECTOR

(75) Inventors: Hideo Takahashi, Shizuoka (JP); Yasuhiro Suzuki, Shizuoka (JP); Naoya Kojima, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/157,811

(22) Filed: May 31, 2002

(65) Prior Publication Data

US 2002/0182898 A1 Dec. 5, 2002

(30) Foreign Application Priority Data

May 31, 2001 (JP) ..... P2001-164230
May 31, 2001 (JP) ..... P2001-164271
May 31, 2001 (JP) ..... P2001-164322

(51) Int. Cl.[7] ..... H01R 11/30
(52) U.S. Cl. ..... 439/39
(58) Field of Search ..... 439/34, 39, 248, 439/383, 384

(56) References Cited

U.S. PATENT DOCUMENTS 3,786,391 A * 1/1974 Mathauser
4,030,797 A * 6/1977 Nieman
5,431,570 A * 7/1995 Gibbs et al. ..... 439/39
5,562,477 A * 10/1996 Moore et al. ..... 439/383
5,803,751 A * 9/1998 Liu ..... 439/39

* cited by examiner

*Primary Examiner*—Khiem Nguyen
(74) *Attorney, Agent, or Firm*—Sughrue Mion, PLLC

(57) ABSTRACT

A first connector includes a first core member, and a first positioning-purpose fitting portion for the second connector. A second connector includes a second core member, in which an induction electromotive force is produced by the first core member, and a second positioning-purpose fitting portion for fitting in the first fitting portion. The first fitting portions, as well as the second fitting portions, may be arranged at opposite sides of the first core member in such a manner that the first core member are interposed between the first fitting portions. A shock-absorbing elastic member, which can be elastically deformed upon contact, may be provided at the first fitting portion (35) and/or the second fitting portion (44).

19 Claims, 26 Drawing Sheets

ELECTROMAGNETIC INDUCTION-TYPE CONNECTOR

BACKGROUND OF THE INVENTION

This invention relates to an electromagnetic induction-type connector in which two members are brought into proximity to each other so as to feed electric power or a signal from one of the two members to the other by mutual induction.

One well-known electromagnetic induction-type connector of this kind is used for supplying electric power between two members such as a car body and a door of an automobile. More specifically, a first connector 4 of an electromagnetic induction-type connector is provided at a boarding port 3 in a car body 2 of an automobile 1, as shown in FIGS. 37 and 38. A second connector 6 of the electromagnetic induction-type connector is mounted on a door 5 for opening and closing the boarding port 3.

The first connector 4 is provided with a guide mechanism 9 including a recess 7 and a moving base 8, and a primary core 10 is supported by this guide mechanism 9 so as to slide (in directions of opening and closing of the door 5). Coil springs 11 and 11 are provided between the bottom of the recess 7 and the moving base 8. An annular permanent magnet 12 is mounted on that side of the moving base 8 on which the primary core 10 is mounted.

The primary core 10 includes a disk portion 13, fixedly secured to the moving base 8, and a cylindrical portion 14 formed on and projecting from a central portion of the disk portion 13. A primary coil 15, comprising a winding of a wire, is wound around the cylindrical portion 14.

The second connector 6 includes a secondary core 18 having a cylindrical wall 16 and a bottom wall 17. A secondary coil 19 is provided on an inner surface of the cylindrical wall 16, and this secondary coil 19 has an internal space for receiving the cylindrical portion 14 of the primary core 10 and the primary coil 15. A permanent magnet 20, similar to the permanent magnet 12 of the first connector 4, is provided at the second connector 6, and is disposed around an open end or edge of the cylindrical wall 16 in closely-spaced relation thereto.

In the above construction, when the door 5 is closed relative to the car body 2, the primary core 10 and the secondary core 18 are abutted against each other. The permanent magnets 12 and 20 attract each other, and the primary core 10 and the secondary core 18 are brought into close proximity to each other, and are coupled or joined together. As a result, mutual induction is produced between the primary coil 15 and the secondary coil 19, so that electric power begins to be supplied from the car body 2 to the door 5.

In the above conventional technique, there was not provided any mechanism for absorbing a misregistration, and therefore when there was a misregistration between the car body 2 and the door 5 (for example, a misregistration due to the improper installation of the door 5 or an aging change), there was a fear that the coupling between the primary core 10 and the secondary core 18 was adversely affected. And besides, there was a fear that the primary core 10 and the secondary core 18 impinged on each other, and were damaged.

Further, in the above conventional technique, when the primary core 10 and the secondary core 18 impinged on each other for some reason upon closing of the door 5 relative to the car body 2, there was a fear that these cores were damaged. And besides, there was not provided any waterproof structure, and therefore there was a fear that water intruded into the car body 2.

Further, in the above conventional technique, when the primary core 10 and the secondary core 18 impinged on each other for some reason upon closing of the door 5 relative to the car body 2, there was a fear that these cores were damaged.

SUMMARY OF THE INVENTION

This invention has been made under the above circumstances, and an object of the invention is to provide an electromagnetic induction-type connector in which a misregistration is absorbed so as to positively achieve the coupling and also to prevent damage.

Another object of the invention is to provide an electromagnetic induction-type connector in which damage due to impingement is prevented. Another object is to provide an electromagnetic induction-type connector which prevents the intrusion of water.

Another object of the invention is to provide an electromagnetic induction-type connector in which damage due to impingement is prevented.

In order to solve the aforesaid object, the invention is characterized by having the following arrangement.

(1) An electromagnetic induction-type connector comprising:

a first connector on a first member which includes a first core member, and a first fitting portion; and a second connector on a second member adapted to be brought into proximity to the first member, which includes a second core member for producing an induction electromotive force in cooperation with the first coil member, and a second fitting portion, for positioning the second connector with respect to the first connector, fitted to the first fitting portion when the second connector is brought into proximity of the first member, wherein electric power or a signal is transmitted between the first connector and the second connector by mutual induction effect when the second member is brought into proximity to the first member.

(2) The electromagnetic induction-type connector according to (1), wherein a plurality of the first fitting portions and a plurality of the second fitting portions are provided at the first and second connectors, respectively.

(3) The electromagnetic induction-type connector according to (2), wherein the plurality of first fitting portions are disposed at opposite sides of the first core member in such a manner that the first core member is interposed between the plurality of first fitting portions, and the plurality of second fitting portions are disposed at opposite sides of the second core member in such a manner that the second core member is interposed between the plurality of second fitting portions.

(4) The electromagnetic induction-type connector according to (1), wherein a shock-absorbing resilient member which can be resiliently deformed when the first fitting portion is fitted to the second fitting portion is provided at at least one of the first fitting portion and the second fitting portion.

(5) The electromagnetic induction-type connector according to (1), wherein the first fitting portion is a recess and the second fitting portion is a projection to be inserted into the recess.

(6) The electromagnetic induction-type connector according to (5), wherein the recess includes a first tapering surface and the projection includes a second tapering surface slidable along the first tapering surface.

(7) The electromagnetic induction-type connector according to (1), wherein a shock-absorbing resilient member which can be resiliently deformed when the first fitting portion is fitted to the second fitting portion is provided at one of the first and second coil members.

(8) The electromagnetic induction-type connector according to (1), wherein one of the first and second connectors includes an elastic member for allowing the first or second core member of the one of the first and second connectors to retract upon contact between the first and second connectors.

(9) The electromagnetic induction-type connector according to (1), wherein the first core member includes a primary core and a primary coil, and the second core member includes a secondary core and a secondary coil.

(10) An electromagnetic induction-type connector comprising:

a first connector on a first member;

a second connector on a second member adapted to be brought into proximity to the first member for producing an induction electromotive force in cooperation with the first connector when the first member is brought into proximity of the second member; and a shock-absorbing resilient member, which can be resiliently deformed upon a contact between the first and second connectors, provided at one of the first and second coil members, wherein electric power or a signal is transmitted between the first connector to the second connector by mutual induction effect when the second member is brought into proximity to the first member.

(11) The electromagnetic induction-type connector according to (10), wherein the shock-absorbing resilient member is provided in the vicinity of a coupling portion of the one of the first and second connectors which cooperates with the other of the first and second connectors to produce the mutual induction.

(12) The electromagnetic induction-type connector according to (11), wherein the shock-absorbing resilient member surrounds the coupling portion.

(13) The electromagnetic induction-type connector according to (11), wherein the shock-absorbing resilient member is provided so as to be brought into contact with a coupling surface of a coupling portion of the other of the first and second connectors which produces the mutual induction.

(14) The electromagnetic induction-type connector according to (10), wherein the shock-absorbing resilient member is provided in the vicinity of a coupling surface of a coupling portion of the one of the first and second connectors which cooperates with the other of the first and second connector to produce the mutual induction.

(15) the electromagnetic induction-type connector according to (10), wherein a resilient member is provided on one of the first connector and the second connector, and when a pressing force above a predetermined value is applied to the resilient member by the contact, the resilient member is resiliently deformed, thereby enabling the one of the first and second connectors having the resilient member to retract.

(16) A electromagnetic induction-type connector comprising:

a first connector on a first member which includes a first core member; and a second connector on a second member adapted to be brought into proximity to the first member, which includes a second core member for producing an induction electromotive force in cooperation with the first coil member;

an elastic member provided at the first connector for allowing the first core member to retract upon contact between the first and second connectors; and a fixing member for fixing the elastic member to the first member, wherein electric power or a signal is transmitted between the first connector and the second connector by mutual induction effect when the second member is brought into proximity to the first member.

(17) The electromagnetic induction-type connector according to (16), wherein the elastic member is watertightly connected to the fixing member, and the elastic member includes a waterproof covering member which watertightly covers the first core member.

(18) The electromagnetic induction-type connector according to (16), wherein a waterproof portion is provided on the first core member, and the elastic member is watertightly connected to the waterproof portion.

BRIEF DESCRIPTION OF THE DRAWINGS

FIG. 6A shows a condition in which the fitting operation is started, and FIG. 6B shows a condition in the middle of the fitting operation, and FIG. 6C shows a condition in which the fitting operation is completed.

DETAILED DESCRIPTION OF PREFERRED EMBODIMENTS

A preferred embodiment of the present invention will now be described with reference to the drawings.

First Embodiment

Figure 1:
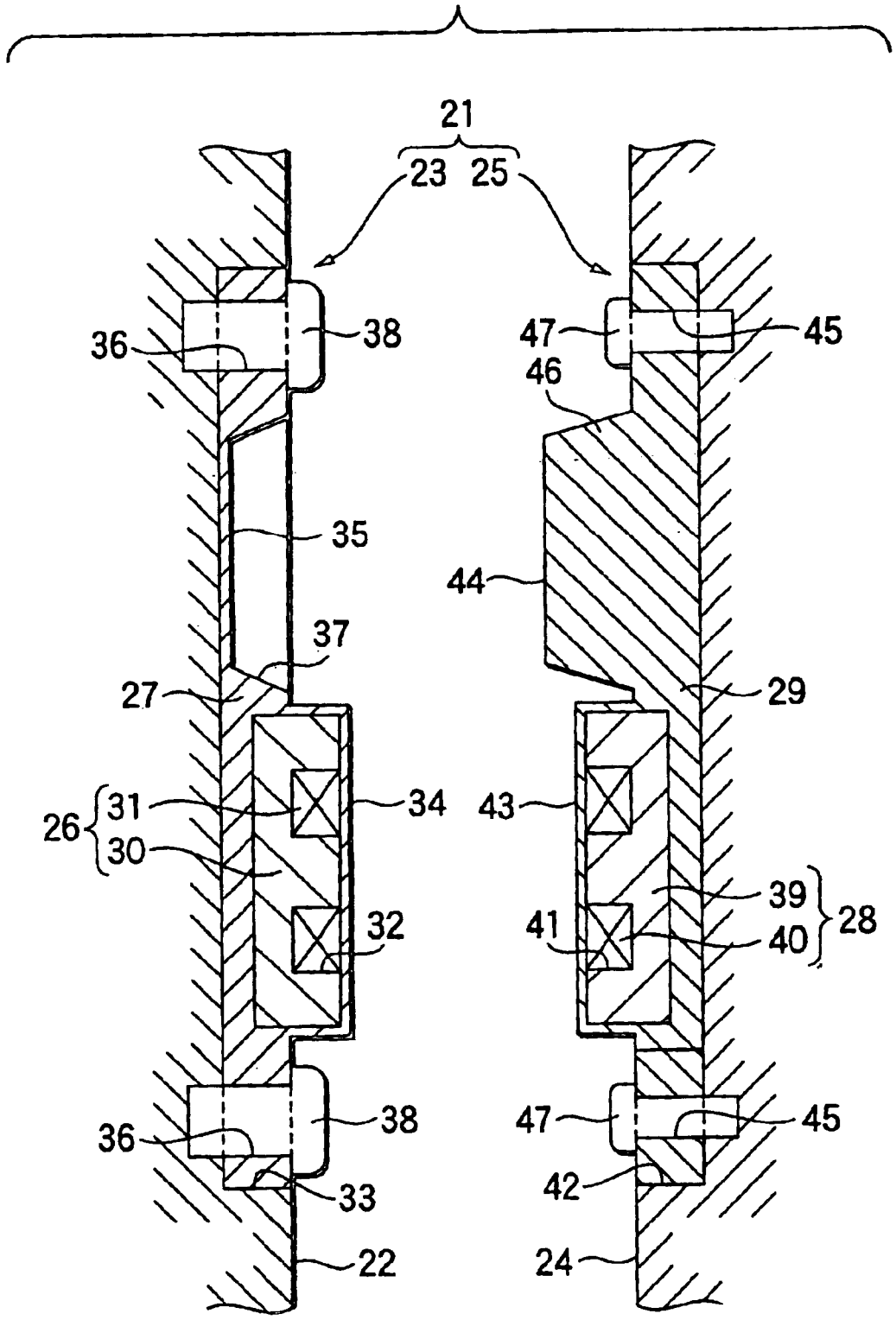
FIG. 1 is a cross-sectional view showing an electromagnetic induction-type connector according to a first embodiment of the present invention.
Figure 2:
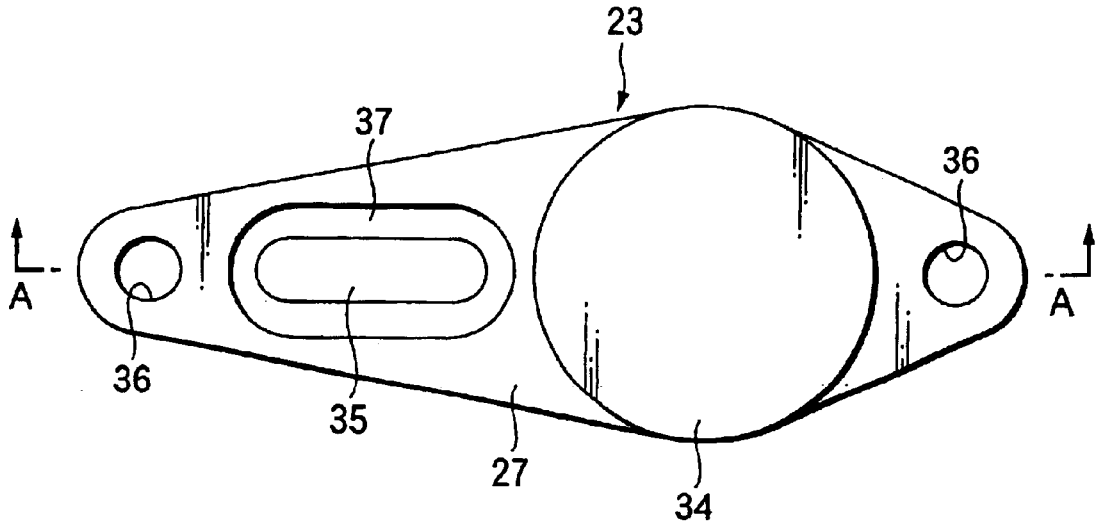
FIG. 2 is a plan view of a first connector of FIG. 1.
Figure 3:
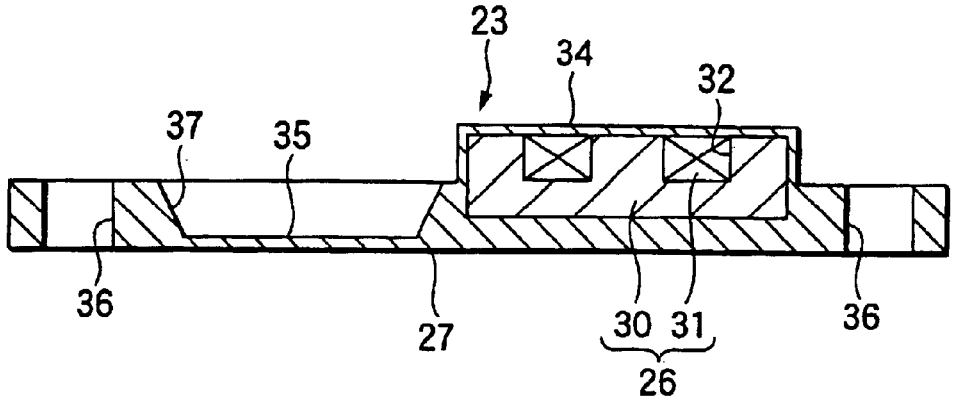
FIG. 3 is a cross-sectional view taken along the line A—A of FIG. 2.
Figure 4:
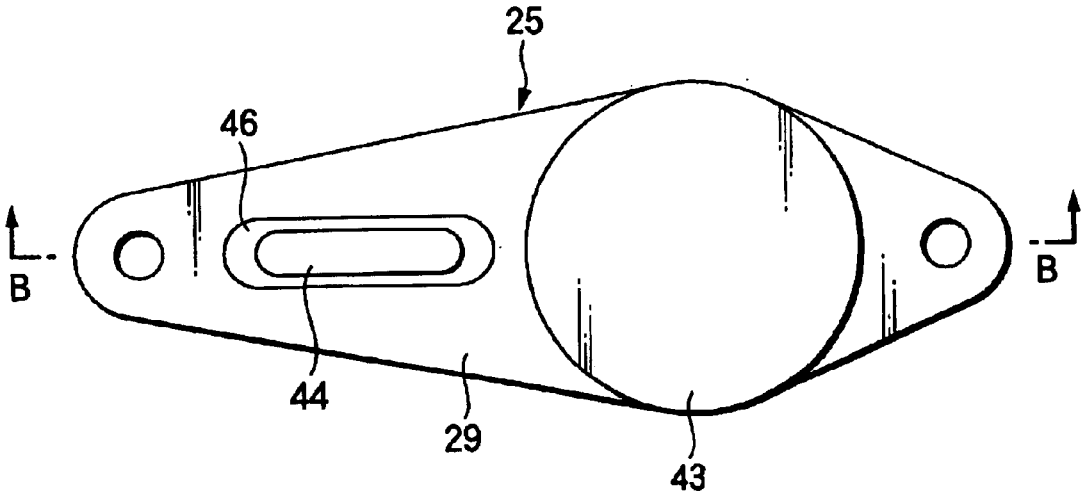
FIG. 4 is a plan view of a second connector of FIG. 1.
Figure 5:
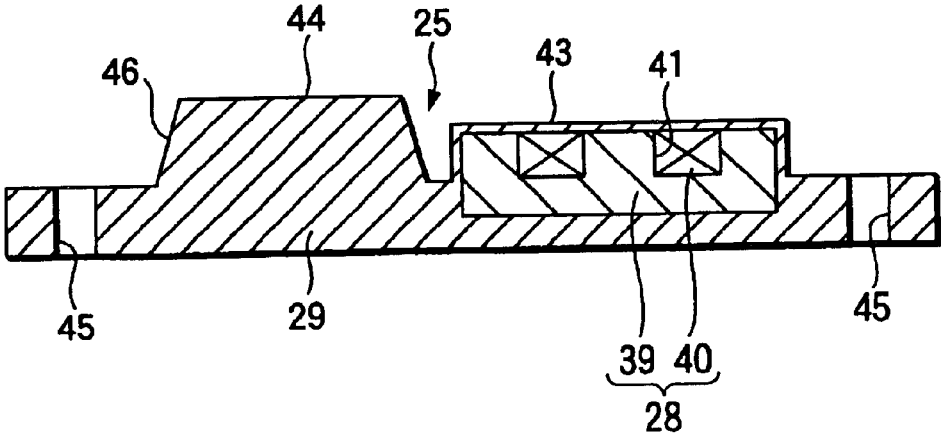
FIG. 5 is a cross-sectional view taken along the line B—B of FIG. 4.
Figure 6A:
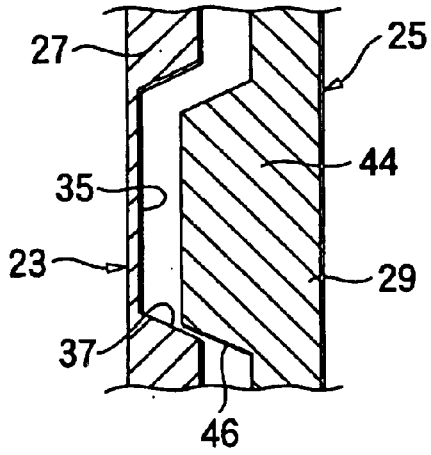
FIGS. 6A to 6C are cross-sectional views explanatory of a fitted condition (a misregistration is encountered) of first and second fitting portions.

FIG. 1 is a cross-sectional view showing one preferred embodiment of an electromagnetic induction-type connector of the present invention. FIG. 2 is a plan view of a first connector, FIG. 3 is a cross-sectional view taken along the line A—A of FIG. 2, FIG. 4 is a plan view of a second connector, FIG. 5 is a cross-sectional view taken along the line B—B of FIG. 4, and FIG. 6 is a cross-sectional view explanatory of a fitted condition (a misregistration is encountered) of first and second fitting portions.

In FIG. 1, reference numeral 21 denotes the electromagnetic induction-type connector. This electromagnetic induction-type connector 21 comprises the first connector 23 provided at a boarding port 22 in a car body of an automobile (corresponding to a first member recited in the claims), and the second connector 25 provided at a peripheral edge portion 24 of a door of the automobile (corresponding to a second member recited in the claims). In the electromagnetic induction-type connector 21 of this embodiment, when the first connector 23 and the second connector 25 are brought into proximity to each other, electric power is supplied from the car body to the door by mutual induction. The electromagnetic induction-type connector 21 is so designed as to absorb a misregistration of the first connector 23 or the second connector 25 due to the improper mounting of the door, an aging change or others.

The first connector 23 comprises a first core member 26, and a first covering member 27 covering this first core member 26 (In this embodiment, the first core member is embedded in the first covering member). The second connector 25 comprises a second core member 28, which is brought into close proximity to the first core member 26 when the door is closed relative to the car body, and a second covering member 29 covering this second core member 28 (In this embodiment, the second core member is embedded in the second covering member).

First, the first connector 23 will be described in further detail with reference to FIGS. 1 to 3.

The first core member 26 comprises a primary core 30, and a primary coil 31. The primary core 30 is formed, for example, by sintering ferrite powder, and this primary core 30 has an annular groove 32 of a channel-shaped cross-section formed in one side thereof. The primary coil 31 is formed by winding a wire, and this primary coil 31 is received in the annular groove 32.

The first covering member 27 is made of a synthetic resin, and is formed into a generally flat plate-like shape, and this first covering member 27 is received in a recess 33 in the boarding port 22, and is fixed thereto so as to be opposed to the second connector 25. The first covering member 27 has a first coupling portion 34, a first fitting portion 35, and screw passage holes 36 and 36.

The first core member 26 is embedded in the first coupling portion 34, and a second coupling portion 43 (described later) of the second connector 25 is brought into close proximity to the first coupling portion 34 when the door is closed. In this embodiment, a distal end surface of the first coupling portion 34 projects beyond the boarding port 22. However, it is not limited to this arrangement. Namely, this distal end surface may be disposed flush with the boarding port 22. The first coupling portion 34 does not always need to cover the whole of the first core member 26 in an embedded manner, but may be shaped to cover the one side of the first core member 26. Namely, the first coupling portion need only to cover the one side of the first core member 26 for protection and waterproof purposes.

The first fitting portion 35 is a recess for positioning the first connector relative to the second connector 25, and has a tapering surface 37 decreasing in size gradually from its open side toward its bottom. This first fitting portion 35 is elongate in the direction of the length of the first covering member 27 (The tapering surface 37 is formed at least in a direction in which the door is deviated from the proper position). The first fitting portion 35 may be separate from the first coupling portion 34. Namely, the first covering member 27 may be formed by two separate members, that is, the first coupling portion 34 and the first fitting portion 35, and the screw passage holes 36 and 36 are formed in these two members, respectively.

Reference numerals 38 and 38 denote bolts for passing respectively through the screw passage holes 36 and 36. The bolts 38 and 38 are threaded respectively into threaded portions formed in the recess portion 33 in the boarding port 22.

Next, the second connector 25 will be described in further detail with reference to FIGS. 1, 4 and 5.

The second core member 28 comprises a secondary core 39, and a secondary coil 40. The secondary core 39 is formed, for example, by sintering ferrite powder, and has an annular groove 41 of a channel-shaped cross-section formed in one side thereof. The secondary coil 40 is formed by winding a wire, and is received in the annular groove 41.

The second covering member 29 is made of a synthetic resin, and is formed into a generally flat plate-like shape, and this second covering member 29 is received in a recess 42 in the peripheral edge portion 24, and is fixed thereto so as to be opposed to the first connector 23 (and hence the first covering member 27). The second covering member 29 has the second coupling portion 43, a second fitting portion 44, and screw passage holes 45 and 45.

The second core member 28 is embedded in the second coupling portion 43, and is brought into close proximity to the first coupling portion 34 of the first connector 23 when the door is closed. In this embodiment, a distal end surface of the second coupling portion 43 projects beyond the peripheral edge portion 24. However, it is not limited to this arrangement. Namely, this distal end surface may be disposed flush with the peripheral edge portion 24. The second coupling portion 43 does not always need to cover the whole of the second core member 28 in an embedded manner, but may be shaped to cover the one side of the second core member 28. Namely, the second coupling portion need only to cover the one side of the second core member 28 for protection and waterproof purposes.

The second fitting portion 44 is a positioning projection, corresponding to the first fitting portion 35 of the first connector 23, and has a tapering surface 46 tapering toward its distal end. This second fitting portion 44 is elongate in the direction of the length of the second covering member 29 (The tapering surface 46 is formed at least in a direction in which the door is deviated from the proper position). The second fitting portion 44 may be separate from the second coupling portion 43. Namely, the second covering member 29 may be formed by two separate members, that is, the second coupling portion 43 and the second fitting portion 44, and the screw passage holes 45 and 45 are formed in these two members, respectively.

Reference numerals 47 and 47 denote bolts for passing respectively through the screw passage holes 45 and 45. The bolts 47 and 47 are threaded respectively into threaded portions formed in the recess portion 42 in the peripheral edge portion 24.

In this embodiment, the first covering member 27 and the second covering member 29 are formed such that the second fitting portion 44 is fitted into the first fitting portion 35 before the second coupling portion 43 is coupled or joined to the first coupling portion 34.

In the above construction, when the door is closed relative to the car body, the first connector 23 and the second connector 25 are abutted against each other. At this time, the second fitting portion 44 is fitted or inserted into the first fitting portion 35, thereby effecting the positioning, and also the first coupling portion 34 and the second coupling portion 43 are brought into proximity to each other (that is, in closely spaced relation to each other or in contact with each other), and therefore are electromagnetically connected or coupled together. Then, when mutual induction is produced between the primary coil 31 and the secondary coil 40, electric power begins to be supplied from the car body to the door.

Figure 6B:
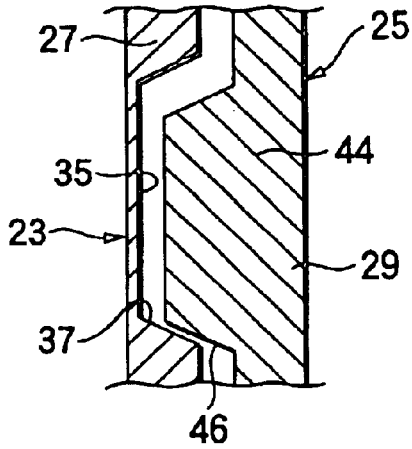
Figure 6C:
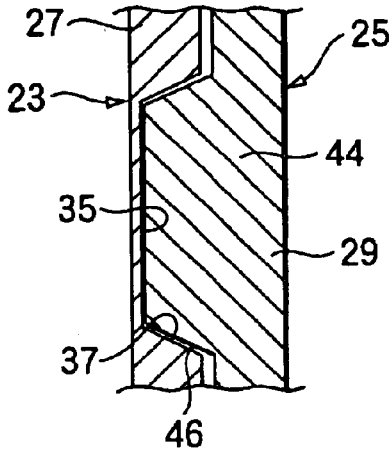

If the misregistration of the second connector 25 relative to the first connector 23 is encountered because of the improper mounting of the door, an aging change or others, the second fitting portion 44 abuts against the tapering surface 37 of the first fitting portion 35 (see FIG. 6A), and then when the door-closing operation proceeds, the second fitting portion 44 slides on the tapering surface 37 of the first fitting portion 35 through the tapering surface 46 (see FIG. 6B). Then, when the second fitting portion 44 is completely fitted into the first fitting portion 35, the misregistration is corrected (see FIG. 6C. The door is moved to the predetermined position). As a result, the electromagnetic coupling or connection between the first coupling portion 34 and the second coupling portion 43 (and hence the first core member 26 and the second core member 28) is secured.

As described above, even when the door is improperly arranged relative to the car body, so that the second connector 25 is deviated from the predetermined position, this position deviation (misregistration) is corrected by the fitting of the second fitting portion 44 into the first fitting portion 35 during the door-closing operation, thereby preventing damage to the first and second coupling portions 34 and 43 and also securing the electromagnetic coupling therebetween. Even if there is encountered such a misregistration that the impingement, causing damage, may occur, this misregistration is first corrected during the door-closing operation, thereby positively preventing the damage.

This connector does not have any permanent magnet as used in the conventional construction, and therefore is free from adverse effects of iron powder (In the conventional connector, when iron powder adhered to the connector, the iron powder remained deposited thereon, which invited a possibility that the electromagnetic coupling could not be effected.). This connector has another advantage that the construction can be simplified (The conventional connector included the permanent magnets and the coil springs, and therefore was complicated in construction.).

Figure 7:
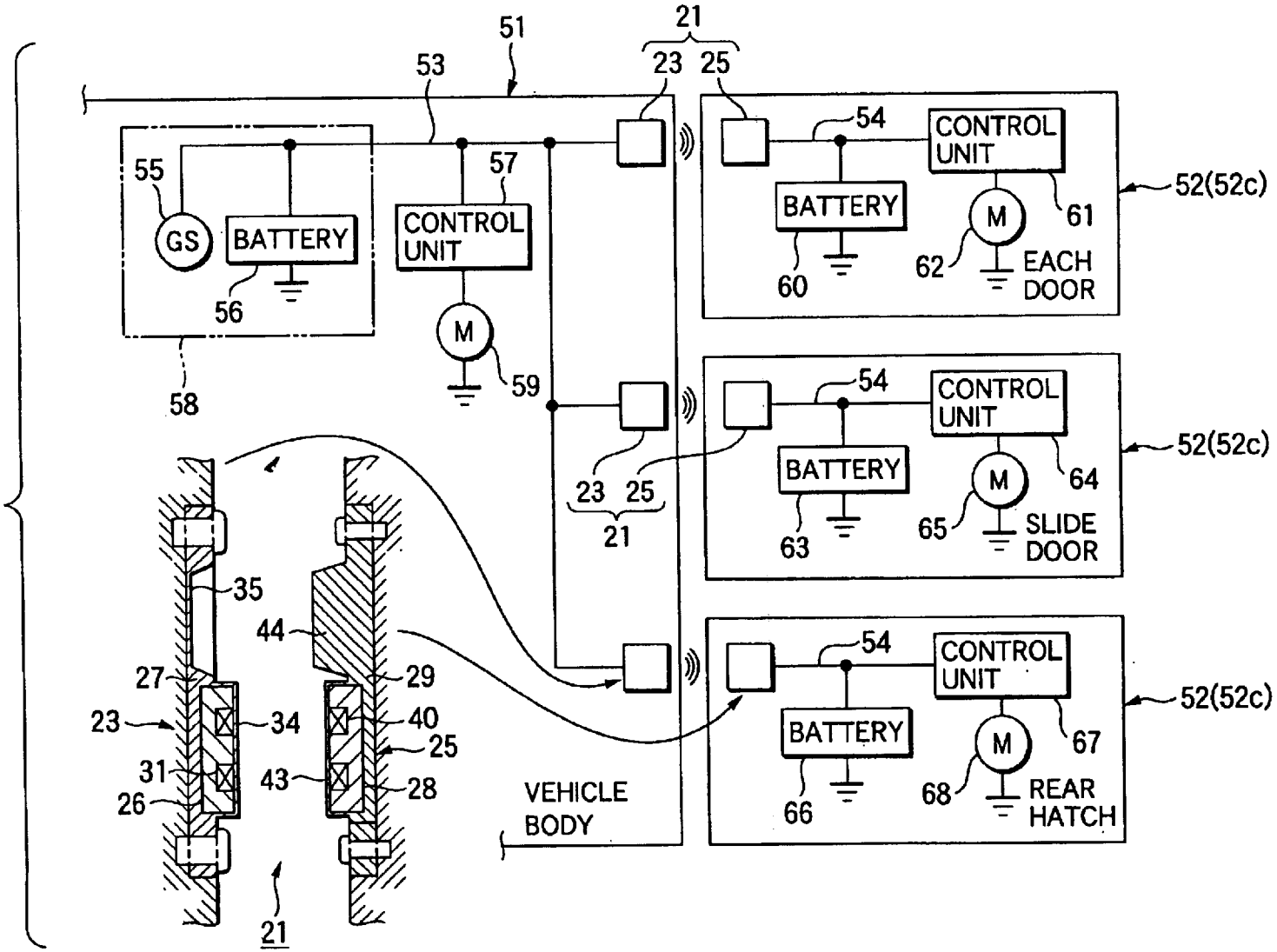
FIG. 7 is a block diagram of one example of an electric power supply system for an automobile, provided with the electromagnetic induction-type connectors of FIG. 1.

One example of an electric power supply system for an automobile, provided with the above electromagnetic induction-type connectors 21, will be described with reference to FIG. 7. FIG. 7 is a block diagram thereof.

In FIG. 7, a plurality of door bodies 52 are mounted on a car body 51 of the automobile so as to be opened and closed relative to this car body 51. The electromagnetic induction-type connector 21 for supplying electric power from the car body 51 to each door body 52 by mutual induction is provided at a door-connecting portion between the car body 51 and each of the door bodies 52. The number of the electromagnetic induction-type connectors 21 corresponds to the number of the door bodies 52, and each of these connectors 21 comprises the first connector 23, mounted on the car body 51, and the second connector 25 mounted on the corresponding door body 52. The first connector 23 is connected to a power supply line 53 provided at the car body 51, and the second connector 25 is connected to a power supply line 54 provided at the corresponding door body 52.

The door bodies 52 are a driver's seat-side door 52*a*, an assistant driver's seat-side door 52*a*, a slide door 52*b*, and a rear hatch 52*c*, respectively. (The car body 51 is a first member recited in the claims while the door body 52 is a second member recited in the claims.)

The construction of each of the above parts will be described. In addition to the first connectors 23 and the power supply line 53, a generator 55, a battery 56, a control unit 57 and so on are mounted on the car body 51. The generator 55 and the battery 56 are mounted within an engine room 58, and the battery 56 is charged with electric power produced by the generator 55. The power supply line 53 is connected to the battery 56, and electric power is supplied from this battery to the control unit 57. For example, a motor 59 is connected to the control unit 57.

The oscillation (driving) of each first connector 23 is controlled by a primary coil oscillation drive control device (not shown). This primary coil oscillation drive control device (not shown) will be described briefly. This control device has the function of an inverter, and can control the exciting of the primary coil 31.

In addition to the second connector 25 and the power supply line 54, a battery 60, a control unit 61 and so on are mounted on the door 52*a*. The battery 60 is charged with an induction electromotive force, produced in the second connector 25, via a rectifier circuit (not shown) and a charging circuit (not shown). The power supply line 54 is connected to the battery 60. The control unit 61 is connected to the power supply line 54, and is supplied with electric power from this power supply line. For example, a motor 62 is connected to the control unit 61.

In addition to the second connector 25 and the power supply line 54, a battery 63, a control unit 64 and so on are mounted on the door 52*b*. The battery 63 is charged with an induction electromotive force, produced in the second connector 25, via a rectifier circuit (not shown) and a charging circuit (not shown). The power supply line 54 is connected to the battery 63. The control unit 64 is connected to the power supply line 54, and is supplied with electric power from this power supply line. For example, a motor 65 is connected to the control unit 64.

In addition to the second connector 25 and the power supply line 54, a battery 66, a control unit 67 and so on are mounted on the rear hatch 52*c*. The battery 66 is charged with an induction electromotive force, produced in the second connector 25, via a rectifier circuit (not shown) and a charging circuit (not shown). The power supply lines 4 is connected to the battery 66. The control unit 67 is connected to the power supply line 54, and is supplied with electric power from this power supply line. For example, a motor 68 is connected to the control unit 67.

In the above construction, each electromagnetic induction-type connector 21 operates in the following manner. First, when a key (not shown) is inserted into an ignition switch, and turns on this ignition switch, electric power is supplied to the primary coil oscillation drive control device (not shown) connected to the power supply line 53. When electric power is thus supplied to the primary coil oscillation drive control device (not shown), the primary coil 31 of each first connector 23 is driven or oscillated by the primary coil oscillation drive control device (not shown), so that an AC electromotive force is produced in the primary coil 31.

When the door 52*a* is closed relative to the car body 51, an induction electromotive force is produced in the secondary coil 40 through mutual induction between the primary coil 31 and the secondary coil 40. The battery 60 is charged with the thus produced induction electromotive force via the rectifier circuit (not shown) and the charging circuit (not shown). When the door 52*a* is open relative to car body 51, electric power is supplied from the battery 60 to the power supply line 54.

When the slide door 52*b* is closed relative to the car body 51, an induction electromotive force is produced in the secondary coil 40 through mutual induction between the primary coil 31 and the secondary coil 40. The battery 63 is charged with the thus produced induction electromotive force via the rectifier circuit (not shown) and the charging circuit (not shown). When the slide door 52*b* is open relative to car body 51, electric power is supplied from the battery 63 to the power supply line 54.

When the rear hatch 52*c* is closed relative to the car body 51, an induction electromotive force is produced in the secondary coil 40 through mutual induction between the primary coil 31 and the secondary coil 40. The battery 66 is charged with the thus produced induction electromotive force via the rectifier circuit (not shown) and the charging circuit (not shown). When the rear hatch 52*c* is open relative to car body 51, electric power is supplied from the battery 66 to the power supply line 54.

Second Embodiment

Figure 8:
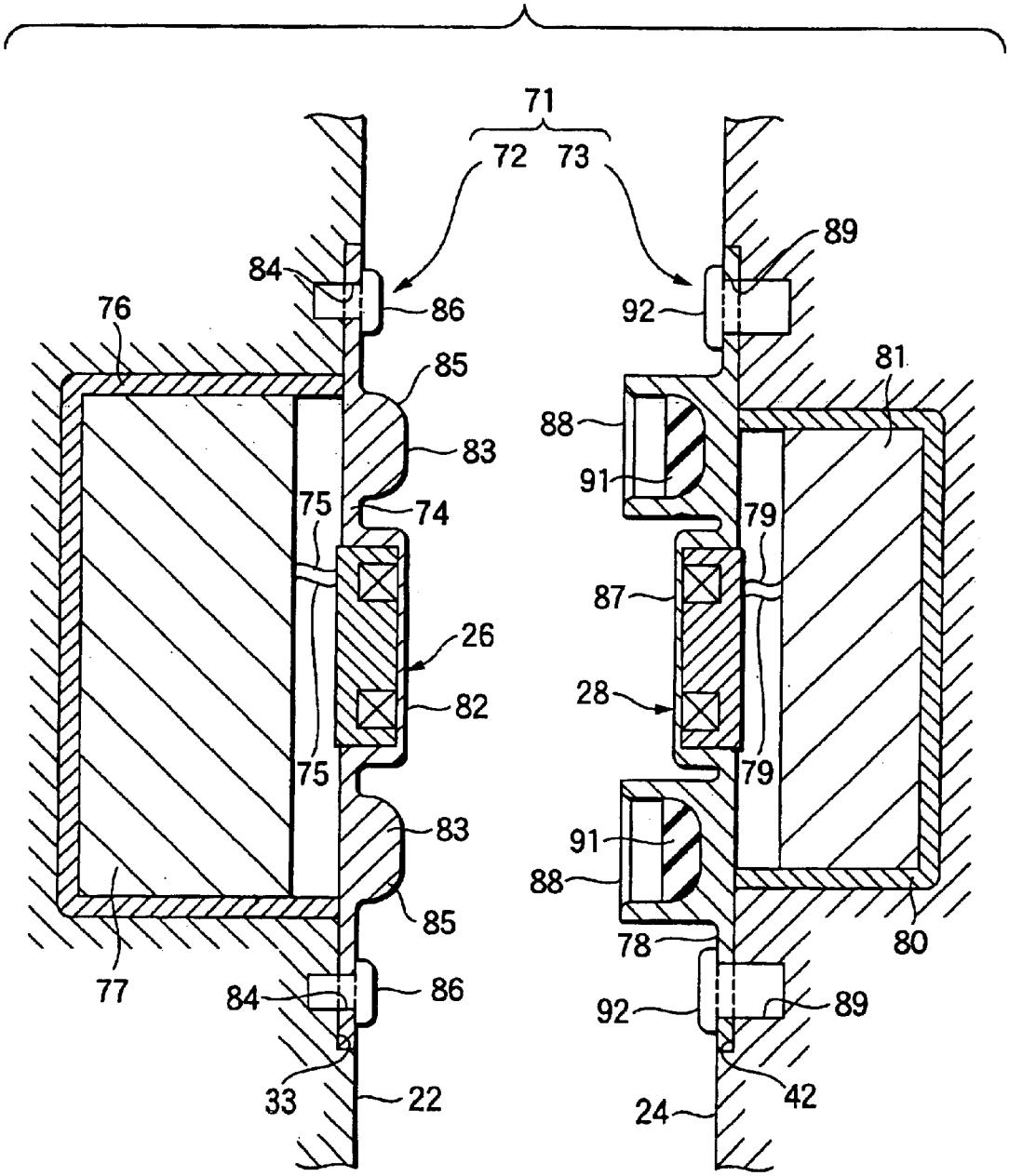
FIG. 8 is a cross-sectional view showing an electromagnetic induction-type connector according to a second embodiment of the invention.
Figure 9:
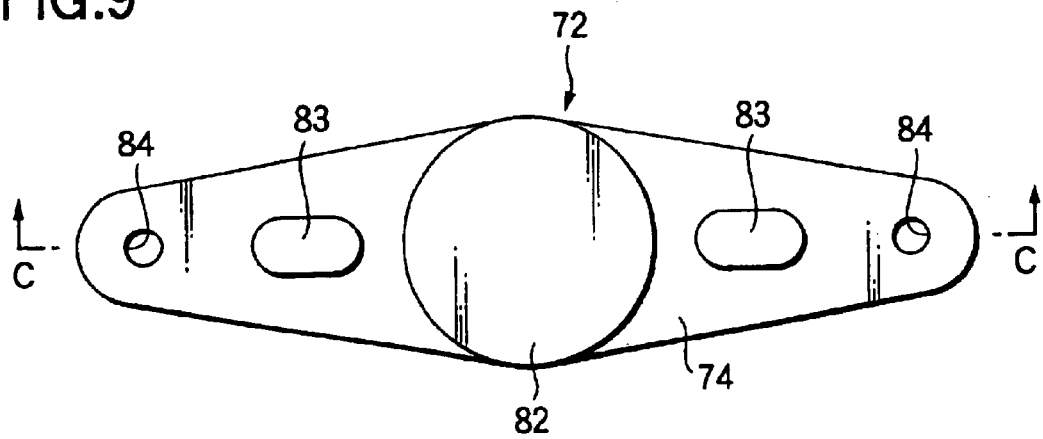
FIG. 9 is a plan view of a first connector of FIG. 8.
Figure 10:
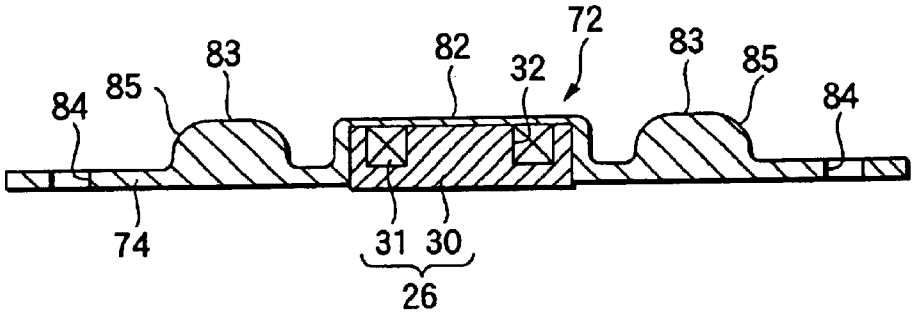
FIG. 10 is a cross-sectional view taken along the line C—C of FIG. 9.
Figure 11:
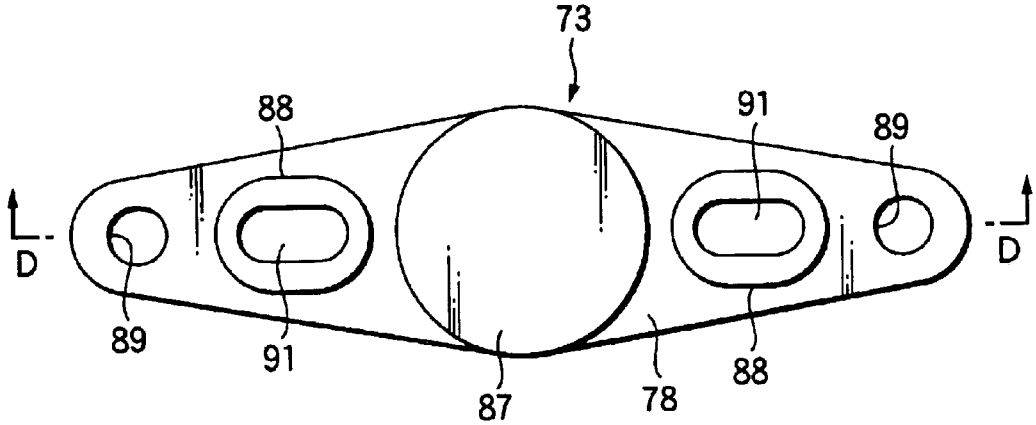
FIG. 11 is a plan view of a second connector of FIG. 8.
Figure 12:
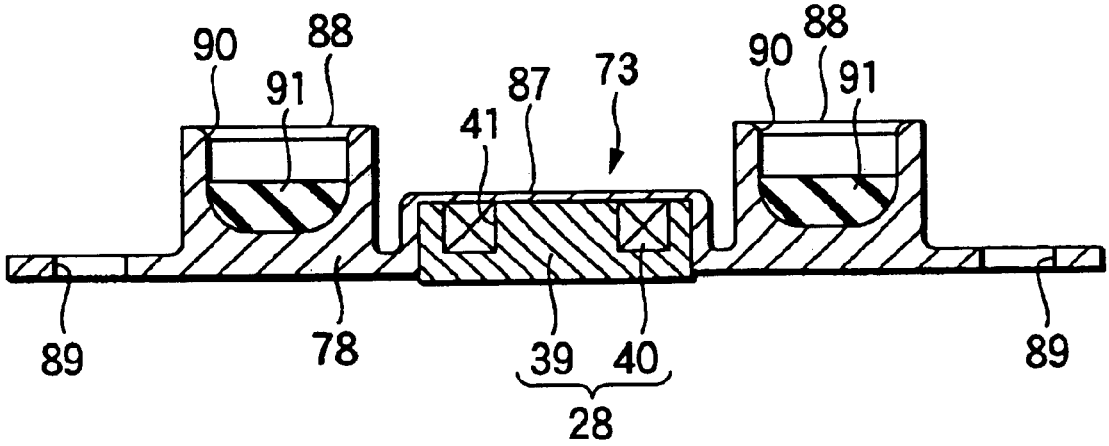
FIG. 12 is a cross-sectional view taken along the line D—D of FIG. 11.
Figure 13:
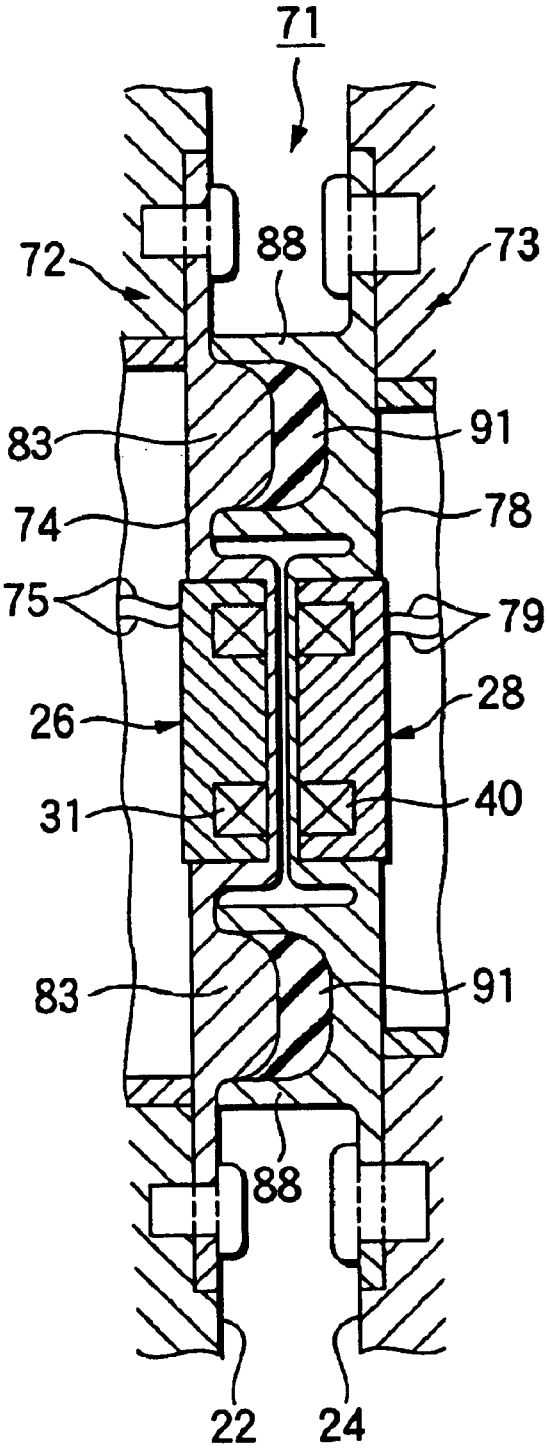
FIG. 13 is a cross-sectional view, showing a condition in which first fitting portions are completely fitted in second fitting portions, respectively.

Next, an electromagnetic induction-type connector according to a second embodiment of the invention will be described with reference to FIGS. 8 to 13. FIG. 8 is a cross-sectional view showing the electromagnetic induction-type connector of the second embodiment. FIG. 9 is a plan view of a first connector of FIG. 8, FIG. 10 is a cross-sectional view taken along the line C—C of FIG. 9, FIG. 11 is a plan view of a second connector of FIG. 8, FIG. 12 is a cross-sectional view taken along the line D—D of FIG. 11, and FIG. 13 is a cross-sectional view, showing a condition in which first fitting portions are completely fitted in second fitting portions, respectively.

In FIG. 8, reference numeral 71 denotes the electromagnetic induction-type connector. This electromagnetic induction-type connector 71 comprises the first connector 72 provided at a boarding port 22 in a car body of an automobile (corresponding to a first member recited in the claims), and the second connector 73 provided at a peripheral edge portion 24 of a door of the automobile (corresponding to a second two member recited in the claims). In the electromagnetic induction-type connector 71 of the second embodiment, when the first connector 72 and the second connector 73 are brought into proximity to each other, electric power is supplied from the car body to the door by mutual induction. The electromagnetic induction-type connector 71 is so designed as to absorb a misregistration of the first connector 72 or the second connector 73 due to the improper mounting of the door, an aging change or others.

In the electromagnetic induction-type connector 71 of the second embodiment, the first fitting portions 83 and 83 and the second fitting portions 88 and 88 are different in number and arrangement from those of the above-mentioned electromagnetic induction-type connector 21 (see FIG. 1), and in addition shock-absorbing elastic (resilient) members 91 and 91 are provided.

The first connector 72 comprises a first core member 26, and a first covering member 74 covering this first core member 26. A primary coil oscillation drive control device 77, received within a casing 76, is connected to the first connector 72 via wires 75 and 75.

The second connector 73 comprises a second core member 28, which is brought into close proximity to the first core member 26 when the door is closed relative to the car body, and a second covering member 78 covering this second core member 28. A rectifier circuit 81, received within a casing 80, is connected to the second connector 73 via wires 79 and 79.

In FIGS. 8 to 10, the first covering member 74 is made of a synthetic resin, and is formed into a generally flat plate-like shape, and this first covering member 74 is received in a recess 33 in the boarding port 22, and is fixed thereto so as to be opposed to the second connector 73. The first covering member 74 has a first coupling portion 82, the pair of first fitting portions 83 and 83, and screw passage holes 84 and 84.

The first coupling portion 82 covers one side of the first core member 26, and a second coupling portion 87 of the second connector 73 (described later) is brought into close proximity to this first coupling portion 82 when the door is closed. In the second embodiment, a distal end surface of the first coupling portion 82 projects beyond the boarding port 22 (However, it is not limited to this arrangement. Namely, this distal end surface may be disposed flush with the boarding port 22.).

Each of the first fitting portions 83 and 83 is a projection for positioning the first connector relative to the second connector 73, and a curved surface 85 is formed at a distal end portion of the first fitting portion 83 over an entire periphery thereof. Each first fitting portion 83 is elongate in the direction of the length of the first covering member 74 (The curved surface 85 is formed at least in a direction in which the door is deviated from the proper position). The two first fitting portions are disposed respectively at opposite sides of the first coupling portion 82 in such a manner that the first coupling portion 82 is interposed between the two first fitting portions (The number of the first fitting portions 83 is not limited to two, but may be three or more. Preferably, these first fitting portions are disposed near to the first coupling portion 82.).

Reference numerals 86 and 86 denote bolts for passing respectively through the screw passage holes 84 and 84. The bolts 86 and 86 are threaded respectively into threaded portions formed in the recess portion 33 in the boarding port 22.

In FIGS. 8, 11 and 12, the second covering member 78 is made of a synthetic resin, and is formed into a generally flat plate-like shape, and this second covering member 78 is received in a recess 42 in the peripheral edge portion 24, and is fixed thereto so as to be opposed to the first connector 72 (and hence the first covering member 74). The second covering member 78 has the second coupling portion 87, the pair of second fitting portions 88 and 88, and screw passage holes 89 and 89.

The second coupling portion 87 covers one side of the second core member 28, and is brought into close proximity to the first coupling portion 82 of the first connector 72 when the door is closed. In the second embodiment, a distal end surface of the second coupling portion 87 projects beyond the peripheral edge portion 24 (However, it is not limited to this arrangement, and this distal end surface may be disposed flush with the peripheral edge portion 24.).

Each of the second fitting portions 88 and 88 is a positioning recess portion (having a generally tubular shape with a closed bottom), corresponding to the first fitting portion 83 of the first connector 72, and a curved surface 90 is formed on an inner surface of the second fitting portion 88 at a distal end thereof over an entire periphery thereof. Each second fitting portion 88 is elongate in the direction of the length of the second covering member 78 (The curved surface 90 is formed at least in a direction in which the door is deviated from the proper position). The two second fitting portions are disposed respectively at opposite sides of the second coupling portion 87 in such a manner that the second coupling portion 87 is interposed between the two second fitting portions (The number of the second fitting portions 88 is not limited to two, but may be three or more. Preferably, these second fitting portions are disposed near to the second coupling portion 87.).

The shock-absorbing elastic member 91 is provided at the inner end or bottom portion of each of the second fitting portions 88 and 88, and this shock-absorbing elastic member 91, when contacted by the corresponding first fitting portion 83, is elastically deformed. In the second embodiment, each shock-absorbing elastic member 91 is made of a rubber material, and is fixedly secured to the second fitting portion by suitable fixing means such as an adhesive (Any suitable material, other than rubber, such as a leaf spring and a coil spring, can be used. The provision of the shock-absorbing elastic members 91 and 91 is preferred.). Such shock-absorbing elastic member 91 may be provided on the distal end of each of the first fitting portions 83 and 83, and also may be provided at the first fitting portion 35 of the preceding embodiment.

Reference numerals 92 and 92 denote bolts for passing respectively through the screw passage holes 89 and 89. The bolts 92 and 92 are threaded respectively into threaded portions formed in the recess portion 42 in the peripheral edge portion 24.

In the second embodiment, the first covering member 74 and the second covering member 78 are formed such that the first fitting portions 83 and 83 are fitted respectively into the second fitting portions 88 and 88 before the first coupling portion 82 is coupled or joined to the second coupling portion 87.

In the above construction, when the door is closed relative to the car body, the first connector 72 and the second connector 73 are abutted against each other. At this time, the first fitting portions 83 and 83 are fitted or inserted respectively into the second fitting portions 88 and 88, thereby effecting the positioning, and also the first coupling portion 82 and the second coupling portion 87 are brought into proximity to each other (that is, in closely spaced relation to each other or in contact with each other), and therefore are electromagnetically connected or coupled together. Then, when mutual induction is produced between the primary coil 31 and the secondary coil 40, electric power begins to be supplied from the car body to the door (Even if a misregistration of the second connector 73 relative to the first connector 72 is encountered because of the improper mounting of the door, an aging change or others, this misregistration is corrected, and the electromagnetic coupling is secured.).

When the door is abruptly closed relative to the car body, the first fitting portions 83 and 83 are brought into contact with the shock-absorbing elastic members 91 and 91, respectively, as shown in FIG. 13, so that an impact, produced upon fitting of each first fitting portion 83 into the corresponding second fitting portion 88, is absorbed by the shock-absorbing elastic member 91.

In the electromagnetic induction-type connector 71 of the second embodiment, there are achieved the effects as obtained with the above-mentioned electromagnetic induction-type connector 21 (see FIG. 1), and besides because of the increased number of first and second fitting portions 83 and 88 and the arrangement thereof, the precision of positioning of the first and second connectors 72 and 73 relative to each other, as well as the precision of positioning of the first and second core members 26 and 28 relative to each other, can be enhanced. Furthermore, by providing the shock-absorbing elastic members 91 and 91, damage to the first and second fitting portions 83 and 88, which would otherwise occur particularly when abruptly bringing the door into proximity to the car body, can be prevented.

Various modifications can be made within the scope of the invention. Namely, although the two members, recited in the claims, are the car body and the door body (the door, the slide door and the rear hatch), respectively, the two members are not limited to these. For example, a tuner and a speaker of an audio equipment can be used as such two members, respectively. Other examples include a steering of a door (separate side: a steering portion), and a seat of an automobile (separate side: a seat portion). The invention can be applied to any suitable two members in so far as electric power need to be supplied from one of the two members to the other. In the above embodiments, although the supply of electric power has been described, the invention can be used for transferring a signal.

As described above, in the invention, even if the two members are arranged improperly, so that one of the first connector and the second connector is deviated from the predetermined position, this position deviation can be corrected by the fitting of the first and second fitting portions relative to each other during the time when the two members are brought into proximity to each other, thereby securing the electromagnetic coupling between the first core member and the second core member and also preventing damage.

In the invention, the precision of positioning of the first and second connectors relative to each other can be enhanced.

In the invention, the precision of positioning of the first and second core members relative to each other can be enhanced.

In the invention, an impact, produced when the first and second fitting portions are fitted together, can be absorbed. Particularly when the two members are abruptly brought into proximity to each other, damage to the first and second fitting portions can be prevented.

Third Embodiment

Figure 14:
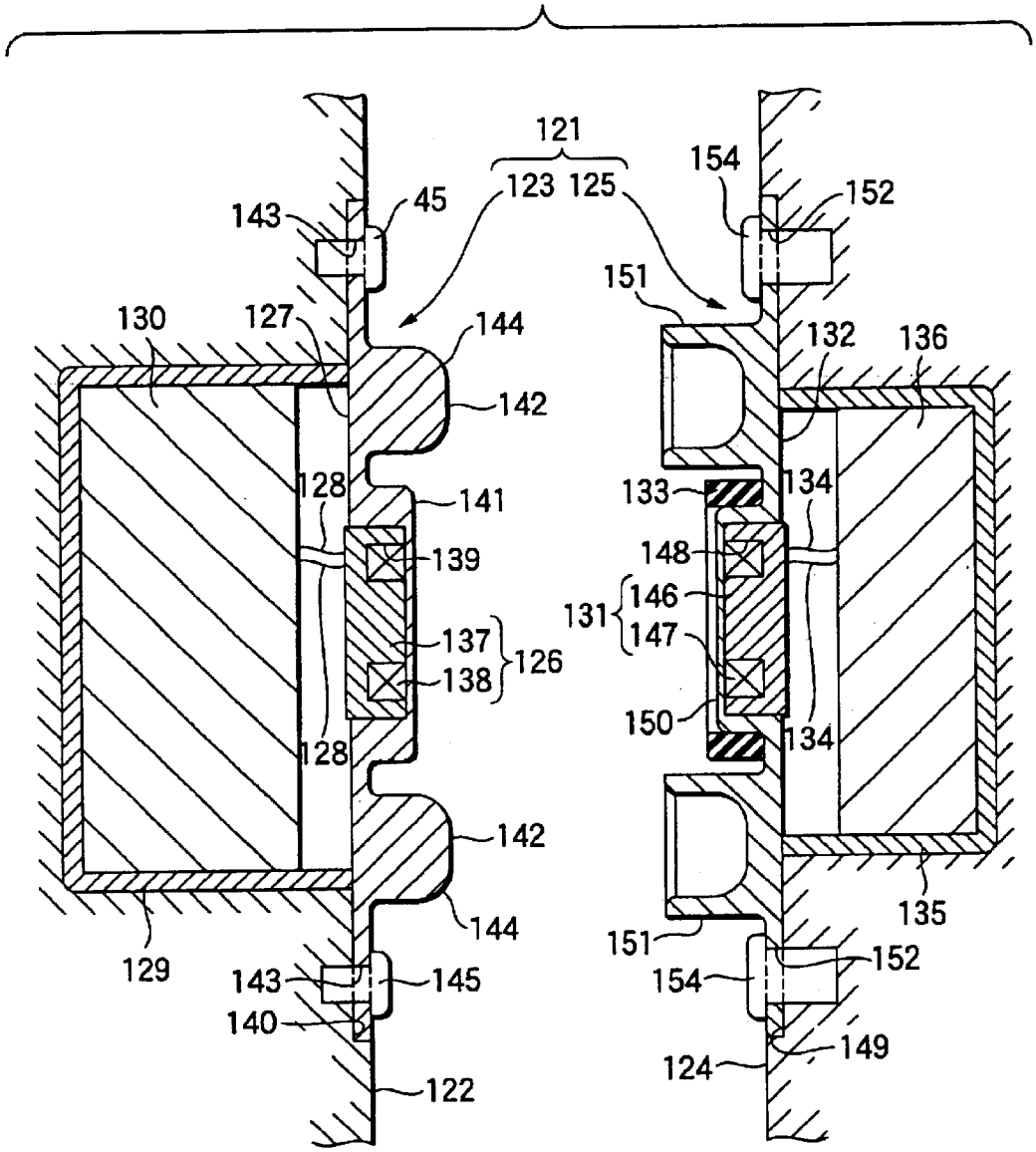
FIG. 14 is a cross-sectional view showing an electromagnetic induction-type connector according to a third embodiment of the present invention.
Figure 15:
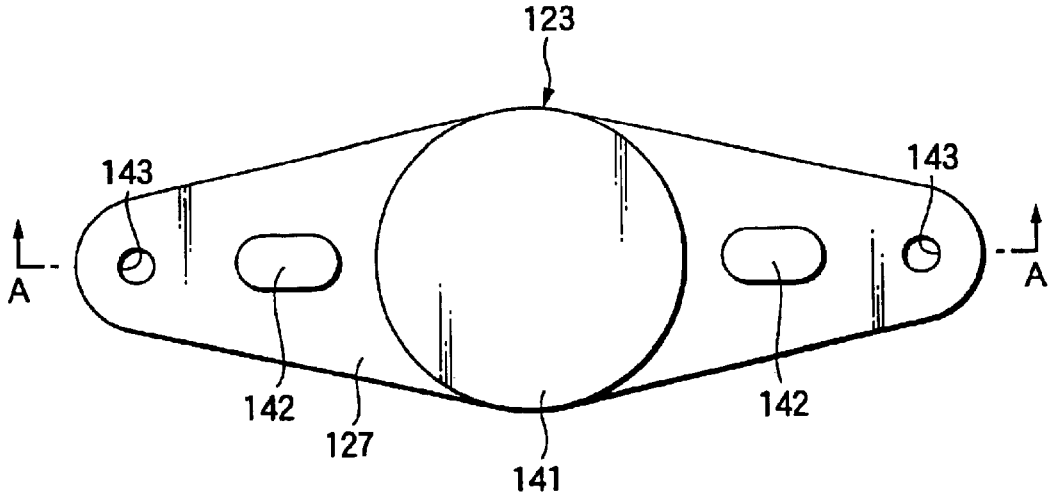
FIG. 15 is a plan view of a first connector of FIG. 14.
Figure 16:
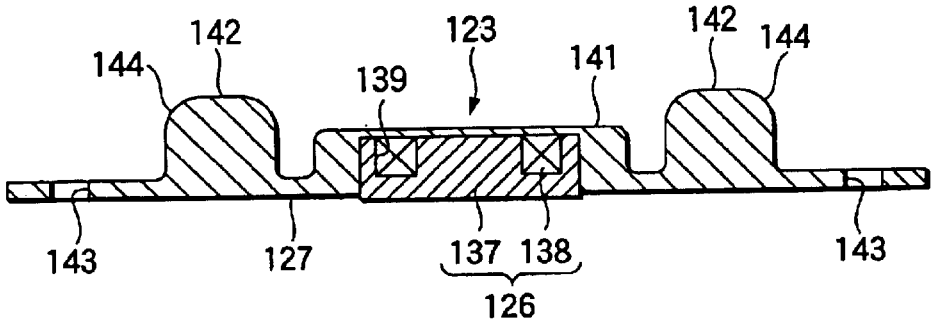
FIG. 16 is a cross-sectional view taken along the line A—A of FIG. 15.
Figure 17:
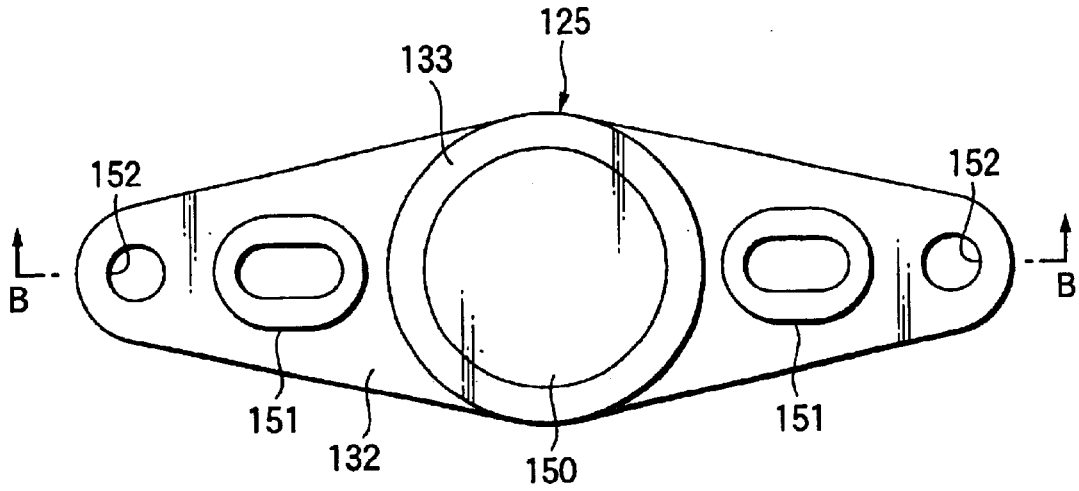
FIG. 17 is a plan view of a second connector of FIG. 14.
Figure 18:
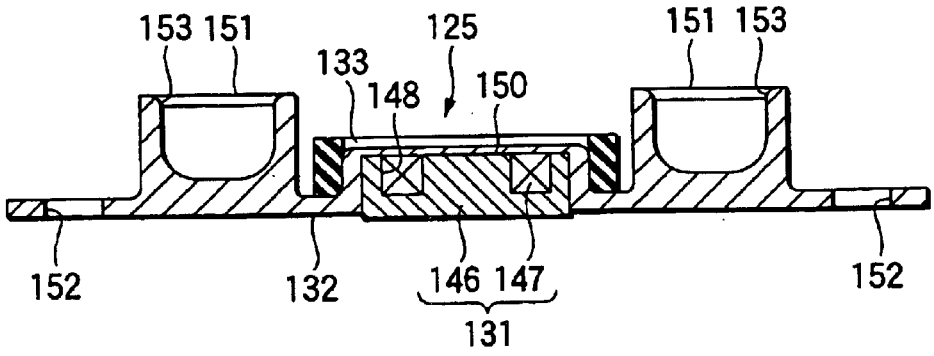
FIG. 18 is a cross-sectional view taken along the line B—B of FIG. 16.
Figure 19:
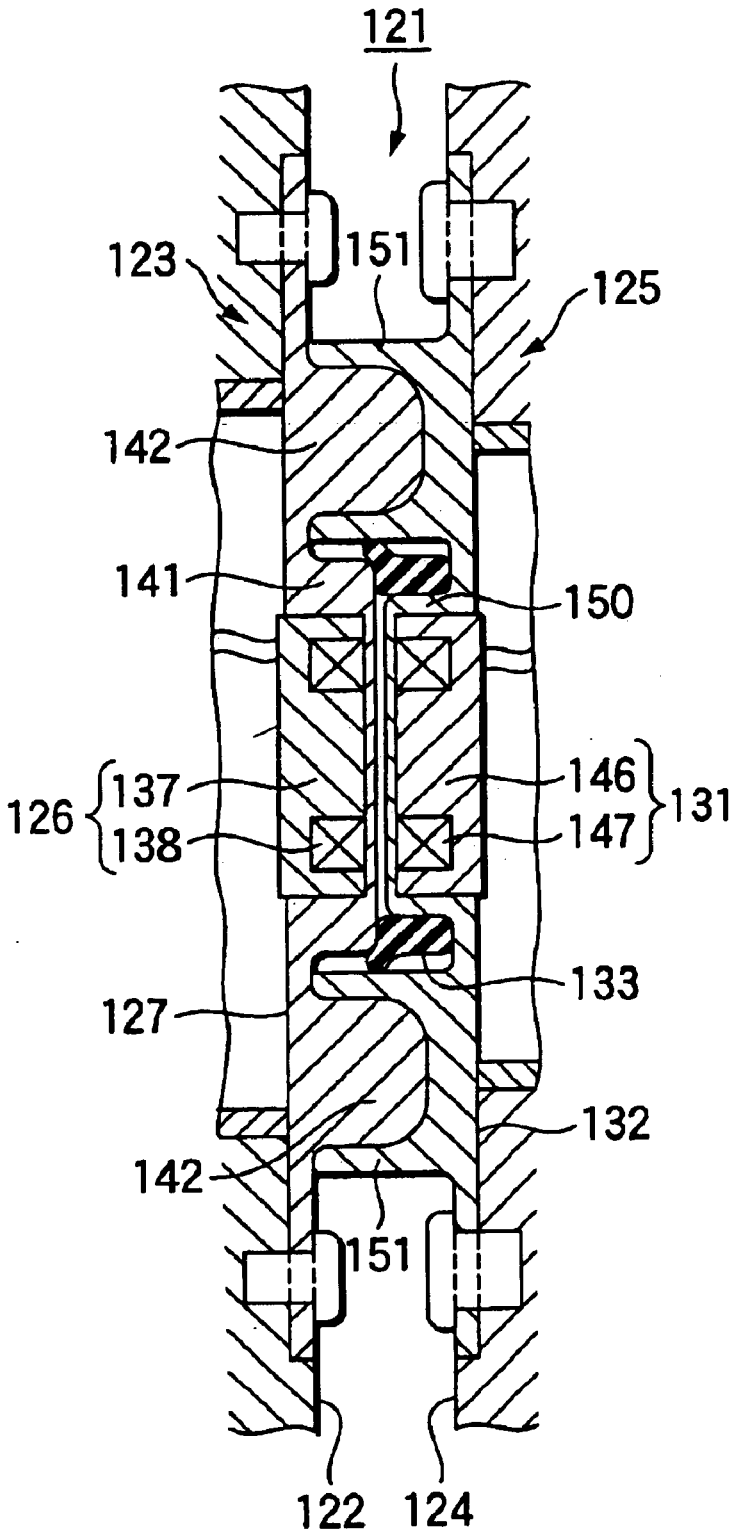
FIG. 19 is a cross-sectional view explanatory of a coupled condition of the first and second connectors.

FIG. 14 is a cross-sectional view showing an electromagnetic induction-type connector according to a third embodiment of the present invention. FIG. 15 is a plan view of a first connector, FIG. 16 is a cross-sectional view taken along the line A—A of FIG. 15, FIG. 17 is a plan view of a second connector, FIG. 18 is a cross-sectional view taken along the line B—B of FIG. 17, and FIG. 19 is a cross-sectional view explanatory of a coupled condition of the first and second connectors.

In FIG. 14, reference numeral 121 denotes the electromagnetic induction-type connector. This electromagnetic induction-type connector 121 comprises the first connector 123, provided at a boarding port 122 in a car body of an automobile (corresponding to a first member recited in the claims), and the second connector 125 provided at a peripheral edge portion 124 of a door of the automobile (corresponding to a second member recited in the claims). In the electromagnetic induction-type connector 121 of this embodiment, when the first connector 123 and the second connector 125 are brought into proximity to each other, electric power is supplied from the car body to the door by mutual induction.

The electromagnetic induction-type connector 121 of this embodiment is so designed as to prevent damage due to impingement. And besides, the electromagnetic induction-type connector 121 of this embodiment is so designed as to absorb a misregistration of the first connector 123 or the second connector 125 due to the improper mounting of the door, an aging change or others.

The first connector 123 comprises a first core member 126, and a first covering member 127 covering this first core member 126. A primary coil oscillation drive control device 130, received within a casing 129, is connected to the first connector 123 via wires 128 and 128. The primary coil oscillation drive control device 130 has the function of an inverter, and controls the exciting of a primary coil 138 (described later).

The second connector 125 comprises a second core member 131, which is brought into close proximity to the first core member 126 when the door is closed relative to the car body, a second covering member 132, covering this second core member 131, and a shock-absorbing elastic (resilient) member 133 mounted on the second covering member 132. A known rectifier circuit 136, received within a casing 135, is connected to the second connector 125 via wires 134 and 134.

First, the first connector 123 will be described in further detail with reference to FIGS. 14 to 16.

The first core member 126 comprises a primary core 137, and a primary coil 138. The primary core 137 is formed, for example, by sintering ferrite powder, and this primary core 137 has an annular groove 139 of a channel-shaped cross-section formed in one side thereof. The primary coil 138 is formed by winding a wire, and this primary coil 138 is received in the annular groove 139.

The first covering member 127 is made of a synthetic resin, and is formed into a generally flat plate-like shape, and this first covering member 127 is received in a recess 140 in the boarding port 122, and is fixed thereto so as to be opposed to the second connector 125. The first covering member 127 has a first coupling portion 141 (corresponding to a coupling portion recited in the claims), a pair of first fitting portions 142 and 142, and screw passage holes 143 and 143.

The first coupling portion 141 covers one side of the first core member 126, and a second coupling portion 150 of the second connector 125 (described later) is brought into close proximity to this first coupling portion 141 when the door is closed. In this embodiment, a distal end surface (corresponding to a coupling surface recited in the claims) of the first coupling portion 141 projects beyond the boarding port 122 (However, it is not limited to this arrangement. Namely, this distal end surface may be disposed flush with the boarding port 122.). In this embodiment, the outer diameter of the first coupling portion 141 is equal to or smaller than the outer diameter of the shock-absorbing elastic material 133 mounted around the second coupling portion 150 (described later) of the second covering member 132 (In the case where the outer diameter of the first coupling portion 141 is smaller, the outer peripheral edge of this first coupling portion bites into the shock-absorbing elastic member 133.).

Each of the first fitting portions 142 and 142 is a projection for positioning the first connector relative to the second connector 125, and a curved surface 144 is formed at a distal end portion of the first fitting portion 142 over an entire periphery thereof (In the case where each of the first fitting portions 142 and 142 is a recess portion, each of second fitting portions 151 and 151 (described later) is a projection.) Each first fitting portion 142 is elongate in the direction of the length of the first covering member 127 (The curved surface 144 is formed at least in a direction in which the door is deviated from the proper position). The two first fitting portions are disposed respectively at opposite sides of the first coupling portion 141 in such a manner that the first coupling portion 141 is interposed between the two first fitting portions (The number of the first fitting portions 142 is not limited to two, but may be three or more. Preferably, these first fitting portions are disposed near to the first coupling portion 141 in order to enhance the positioning precision.).

Reference numerals 145 and 145 denote bolts for passing respectively through the screw passage holes 143 and 143. The bolts 145 and 145 are threaded respectively into threaded portions formed in the recess portion 140 in the boarding port 122.

Next, the second connector 125 will be described in further detail with reference to FIGS. 14, 17 and 18.

The second core member 131 comprises a secondary core 146, and a secondary coil 147. The secondary core 146 is formed, for example, by sintering ferrite powder, and has an annular groove 148 of a channel-shaped cross-section formed in one side thereof. The secondary coil 147 is formed by winding a wire, and is received in the annular groove 148.

The second covering member 132 is made of a synthetic resin, and is formed into a generally flat plate-like shape, and this second covering member 132 is received in a recess 149 in the peripheral edge portion 124, and is fixed thereto so as to be opposed to the first connector 123 (and hence the first covering member 127). The second covering member 132 has the second coupling portion 150 (corresponding to a coupling portion recited in the claims), the pair of second fitting portions 151 and 151, and screw passage holes 152 and 152.

The second coupling portion 150 covers one side of the second core member 131, and is brought into close proximity to the first coupling portion 141 of the first connector 123 when the door is closed. In this embodiment, a distal end surface (corresponding to a coupling surface recited in the claims) of the second coupling portion 150 projects beyond the peripheral edge portion 124 (However, it is not limited to this arrangement, and this distal end surface may be disposed flush with the peripheral edge portion 124.).

Each of the second fitting portions 151 and 151 is a positioning recess portion (having a generally tubular shape with a closed bottom), corresponding to the first fitting portion 142 of the first connector 123, and a curved surface 153 is formed on an inner surface of the second fitting portion 151 at a distal end thereof over an entire periphery thereof. Each second fitting portion 151 is elongate in the direction of the length of the second covering member 132 (The curved surface 153 is formed at least in a direction in which the door is deviated from the proper position). The two second fitting portions are disposed respectively at opposite sides of the second coupling portion 150 in such a manner that the second coupling portion 50 is interposed between the two second fitting portions (The number of the second fitting portions 151 is not limited to two, but may be three or more. Preferably, these second fitting portions are disposed near to the second coupling portion 150 in order to enhance the positioning precision.).

Reference numerals 154 and 154 denote bolts for passing respectively through the screw passage holes 152 and 152. The bolts 154 and 154 are threaded respectively into threaded portions formed in the recess portion 149 in the peripheral edge portion 124.

In this embodiment, the first covering member 127 and the second covering member 132 are formed such that the first fitting portions 142 and 142 are fitted respectively into the second fitting portions 151 and 151 before the first coupling portion 141 is coupled or joined to the second coupling portion 150.

In this embodiment, the shock-absorbing elastic member 133 is made of a rubber material, and is formed into an annular shape, and is fixed either in the vicinity of the second coupling portion 150 or in surrounding relation to the second coupling portion 150 by suitable fixing means such as an adhesive (Any suitable material, other than rubber, such as a leaf spring and a coil spring, can be used.). The distal end of the shock-absorbing elastic member 133 is disposed at a position higher than the distal end surface of the second coupling portion 150 (that is, projects beyond this distal end surface). The shock-absorbing elastic member 133 can be elastically deformed so as to absorb an impact.

In this embodiment, the amount of projecting of the distal end of the shock-absorbing elastic member 133 beyond the distal end surface of the second coupling portion 150 is so determined that a predetermined gap is formed between the distal end surface of the first coupling portion 141 and the distal end surface of the second coupling portion 150 when the shock-absorbing elastic member 133 is elastically deformed. In the case where the outer diameter of the first coupling portion 141 is equal to the outer diameter of the second coupling portion 150, it is necessary that the height of the shock-absorbing elastic member 133 should be made sufficiently large. A plurality of pillar-like shock-absorbing elastic members may be provided around the second coupling portion 150 at equal intervals. When the shock-absorbing elastic member 133 is provided in surrounding relation to the second coupling portion 150, there is obtained an advantage that the transmission of an impact to the second coupling portion 150 is suppressed.

In the above construction, when the door is closed relative to the car body, the first connector 123 and the second connector 125 are abutted against each other as shown in FIG. 19. At this time, the first fitting portions 142 and 142 are fitted respectively into the second fitting portions 151 and 151, thereby effecting the positioning, and also the shock-absorbing elastic member 133 is brought into contact with the distal end surface of the first coupling portion 141, so that this shock-absorbing elastic member 133 is elastically deformed to absorb an impact. Then, the first coupling portion 141 and the second coupling portion 150 are brought into proximity to each other, and therefore are electromagnetically connected or coupled together. Then, when mutual induction is produced between the primary coil 138 and the secondary coil 147, electric power begins to be supplied from the car body to the door.

Even when the door is abruptly closed relative to the car body, an impact is absorbed by the shock-absorbing elastic member 133. Even if a misregistration of the second connector 125 relative to the first connector 123 is encountered because of the improper mounting of the door, an aging change or others, this misregistration is corrected by the fitting of the first fitting portions 142 and 142 into the respective second fitting portions 151 and 151 (The electromagnetic coupling is secured. This construction is useful since the conventional connector is not provided with any means for absorbing such misregistration.).

As described above, the shock-absorbing elastic member 133 absorbs an impact, and therefore damage to the first connector 123 and/or the second connector 125 due to impingement is prevented. The shock-absorbing elastic member 133 absorbs an impact in the vicinity of the first coupling portion 141 and the second coupling portion 150, and therefore particularly damage to the first and second coupling portions 141 and 150 is prevented. And besides, the shock-absorbing elastic member 133 surrounds the second coupling portion 150, and therefore the impact can be absorbed in a stable manner, and damage to the first coupling portion 141 and/or the second coupling portion 150 can be more effectively prevented. Furthermore, the shock-absorbing elastic member 133 is brought into contact with (or abuts against) the distal end surface of the first coupling portion 141, the impingement of the first and second coupling portions 41 and 150 upon each other can be more effectively prevented.

This connector does not have any permanent magnet as used in the conventional construction, and therefore is free from adverse effects of iron powder (In the conventional connector, when iron powder adhered to the connector, the iron powder remained deposited thereon, which invited a possibility that the electromagnetic coupling could not be effected.). This connector has another advantage that the construction can be simplified.

Figure 20:
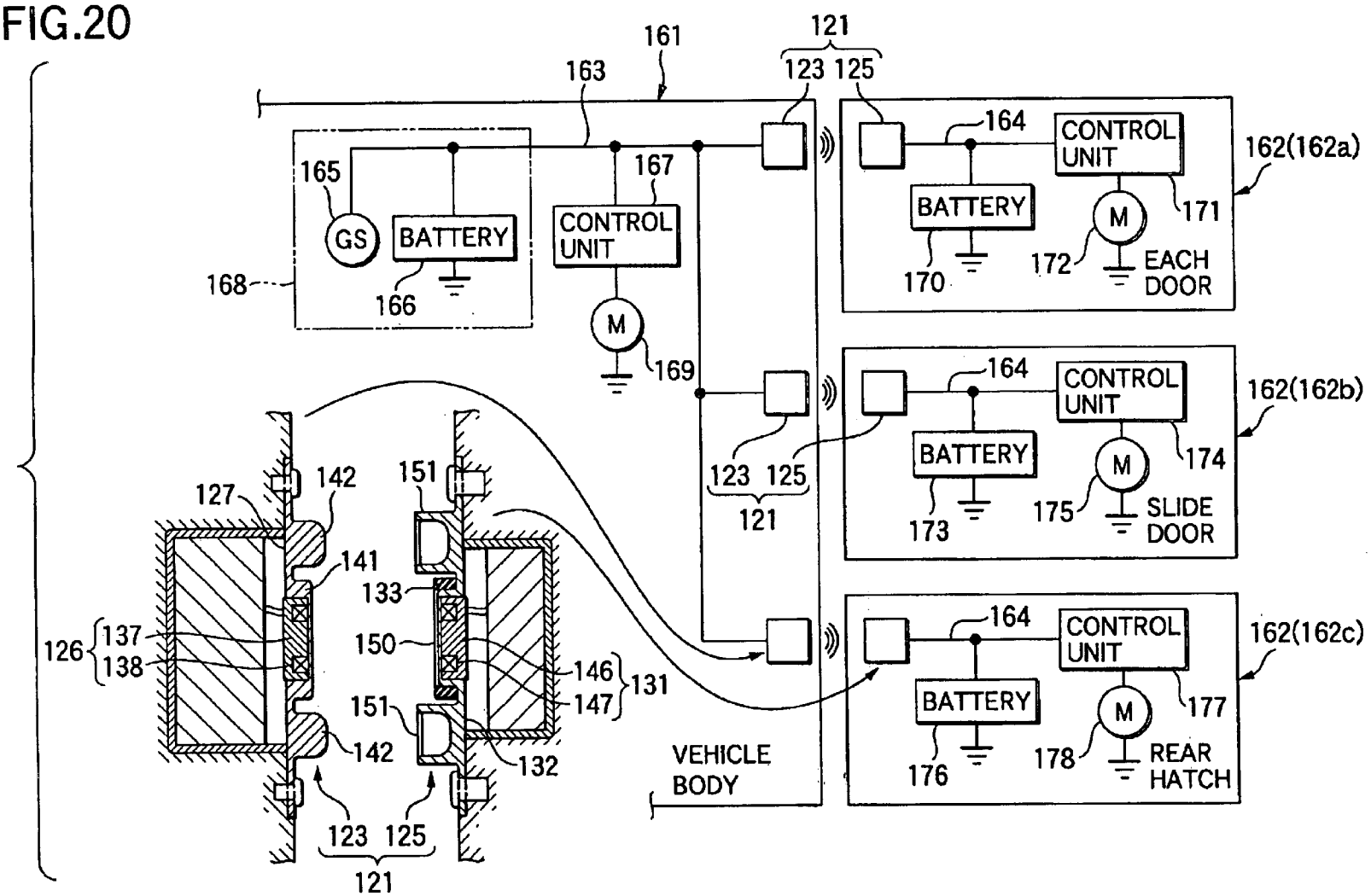
FIG. 20 is a block diagram of one example of an electric power supply system for an automobile, provided with the electromagnetic induction-type connectors of FIG. 14.

One example of an electric power supply system for an automobile, provided with the above electromagnetic induction-type connectors 121, will be described with reference to FIG. 20. FIG. 20 is a block diagram thereof.

In FIG. 20, a plurality of door bodies 162 are mounted on a car body 61 of the automobile so as to be opened and closed relative to this car body 161. The electromagnetic induction-type connector 121 for supplying electric power from the car body 161 to each door body 162 by mutual induction is provided at a door-connecting portion between the car body 161 and each of the door bodies 162. The number of the electromagnetic induction-type connectors 121 corresponds to the number of the door bodies 162, and each of these connectors 121 comprises the first connector 123, mounted on the car body 161, and the second connector 125 mounted on the corresponding door body 162. The first connector 123 is connected to a power supply line 163 provided at the car body 161, and the second connector 125 is connected to a power supply line 164 provided at the corresponding door body 162.

The door bodies 162 are a driver's seat-side door 162*a*, an assistant driver's seat-side door 162*a*, a slide door 162*b*, and a rear hatch 162*c*, respectively. (The car body 161 is a first member recited in the claims while the door body 162 is a second member recited in the claims.)

The construction of each of the above parts will be described. In addition to the first connectors 123 and the power supply line 163, a generator 165, a battery 166, a control unit 167 and soon are mounted on the car body 161. The generator 165 and the battery 166 are mounted within an engine room 168, and the battery 166 is charged with electric power produced by the generator 165. The power supply line 163 is connected to the battery 166, and electric power is supplied from this battery to the control unit 167. For example, a motor 169 is connected to the control unit 167.

The oscillation (driving) of each first connector 123 is controlled by the primary coil oscillation drive control device 130 (not shown here. See FIG. 14) connected to the power supply line 163.

In addition to the second connector 125 and the power supply line 164, a battery 170, a control unit 171 and so on are mounted on the door 162*a*. The battery 170 is charged with an induction electromotive force, produced in the second connector 125, via a rectifier circuit (not shown) and a charging circuit (not shown). The power supply line 164 is connected to the battery 170. The control unit 171 is connected to the power supply line 164, and is supplied with electric power from this power supply line. For example, a motor 172 is connected to the control unit 171.

In addition to the second connector 125 and the power supply line 164, a battery 173, a control unit 174 and so on are mounted on the door 162*b*. The battery 173 is charged with an induction electromotive force, produced in the second connector 125, via a rectifier circuit (not shown) and a charging circuit (not shown). The power supply line 164 is connected to the battery 173. The control unit 174 is connected to the power supply line 164, and is supplied with electric power from this power supply line. For example, a motor 175 is connected to the control unit 174.

In addition to the second connector 125 and the power supply line 164, a battery 176, a control unit 177 and so on are mounted on the rear hatch 162*c*. The battery 176 is charged with an induction electromotive force, produced in the second connector 125, via a rectifier circuit (not shown) and a charging circuit (not shown). The power supply line 164 is connected to the battery 176. The control unit 177 is connected to the power supply line 164, and is supplied with electric power from this power supply line. For example, a motor 178 is connected to the control unit 177.

In the above construction, each electromagnetic induction-type connector 121 operates in the following manner. First, when a key (not shown) is inserted into an ignition switch, and turns on this ignition switch, electric power is supplied to each primary coil oscillation drive control device 130 (not shown here. See FIG. 14) connected to the power supply line 163. When electric power is thus supplied to the primary coil oscillation drive control device 130 (not shown here. See FIG. 14), the primary coil 138 of each first connector 123 is driven or oscillated by the primary coil oscillation drive control device 130 (not shown here. See FIG. 14), so that an AC electromotive force is produced in the primary coil 138.

When the door 162*a* is closed relative to the car body 161, an induction electromotive force is produced in the secondary coil 147 through mutual induction between the primary coil 38 and the secondary coil 147. The battery 170 is charged with the thus produced induction electromotive force via the rectifier circuit (not shown) and the charging circuit (not shown). When the door 162*a* is open relative to car body 161, electric power is supplied from the battery 170 to the power supply line 164.

When the slide door 162*b* is closed relative to the car body 161, an induction electromotive force is produced in the secondary coil 147 through mutual induction between the primary coil 138 and the secondary coil 147. The battery 173 is charged with the thus produced induction electromotive force via the rectifier circuit (not shown) and the charging circuit (not shown). When the slide door 162*b* is open relative to car body 161, electric power is supplied from the battery 173 to the power supply line 164.

When the rear hatch 162*c* is closed relative to the car body 161, an induction electromotive force is produced in the secondary coil 147 through mutual induction between the primary coil 138 and the secondary coil 147. The battery 176 is charged with the thus produced induction electromotive force via the rectifier circuit (not shown) and the charging circuit (not shown). When the rear hatch 162*c* is open relative to car body 161, electric power is supplied from the battery 176 to the power supply line 164.

Fourth Embodiment

Figure 21:
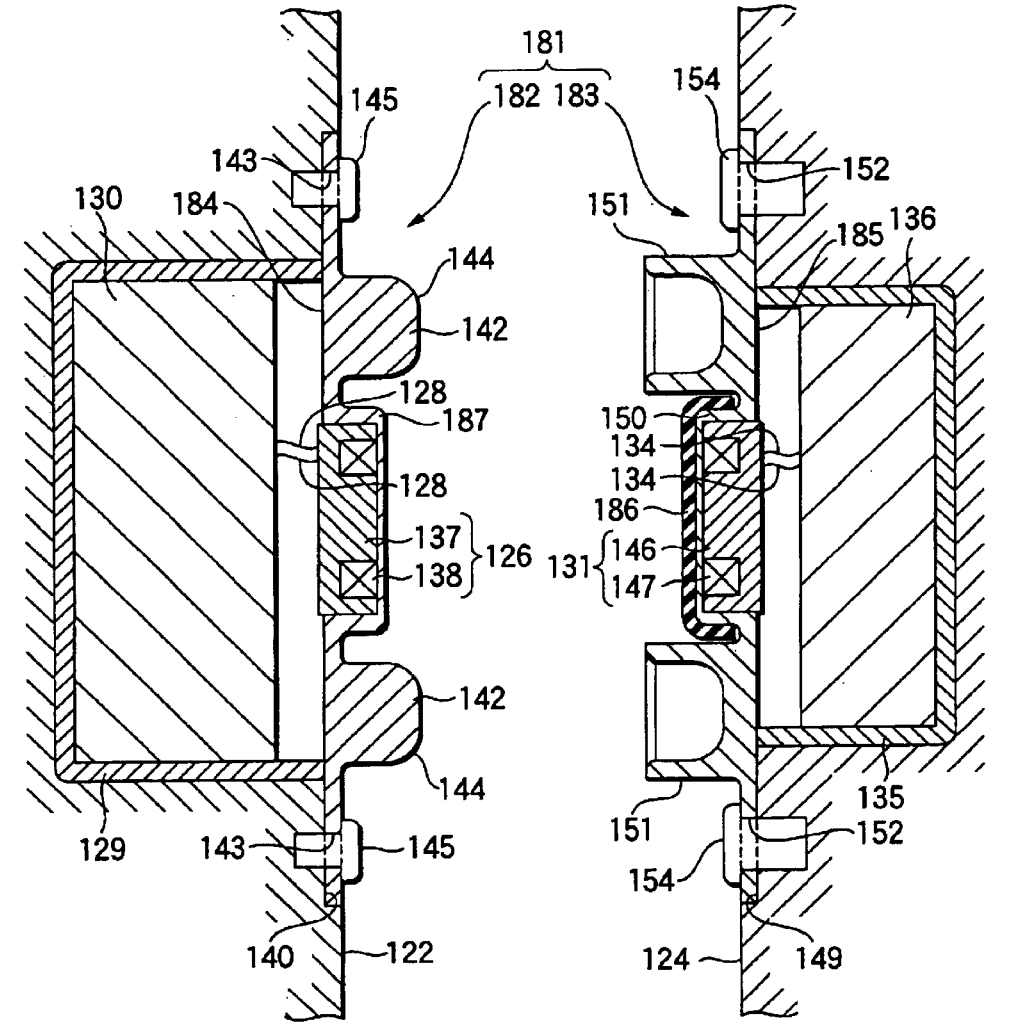
FIG. 21 is a cross-sectional view showing an electromagnetic induction-type connector according to a fourth embodiment of the invention.
Figure 22:
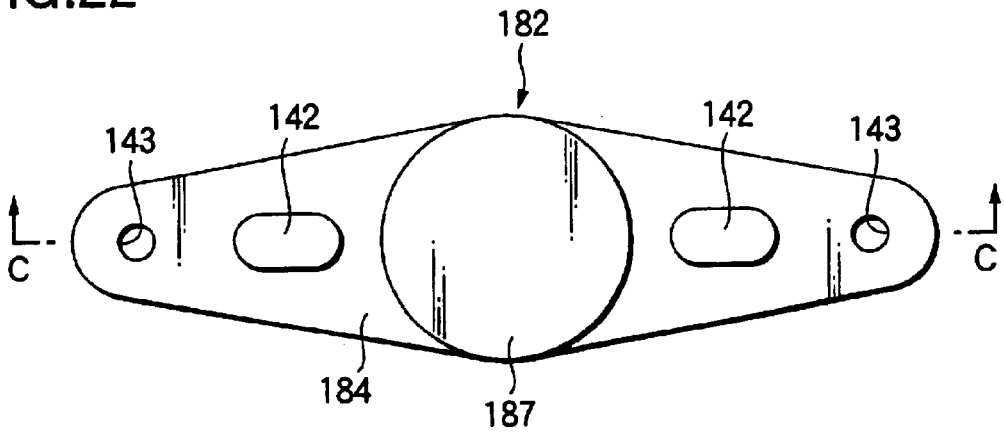
FIG. 22 is a plan view of a first connector of FIG. 21.
Figure 23:
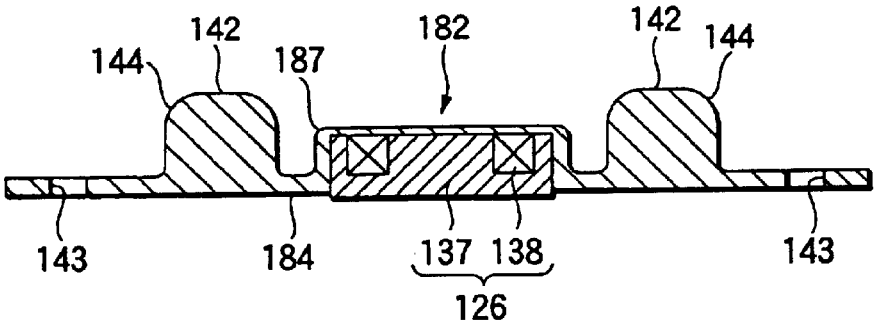
FIG. 23 is a cross-sectional view taken along the line C—C of FIG. 22.
Figure 24:
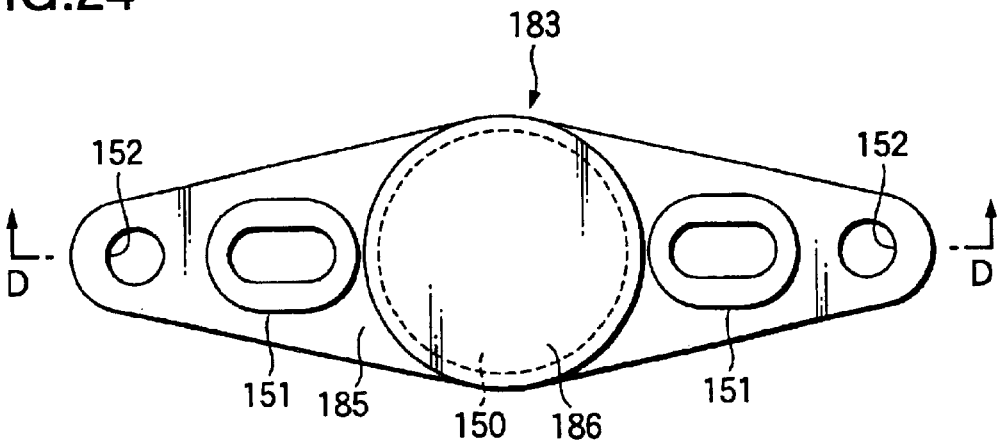
FIG. 24 is a plan view of a second connector of FIG. 21.
Figure 25:
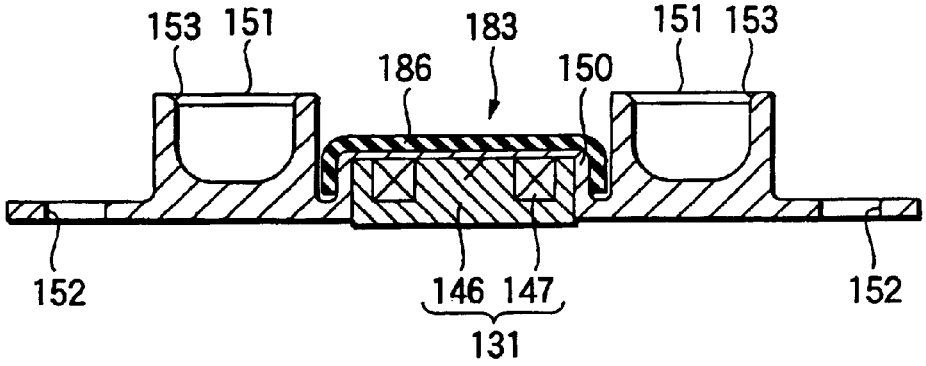
FIG. 25 is a cross-sectional view taken along the line D—D of FIG. 24.
Figure 26:
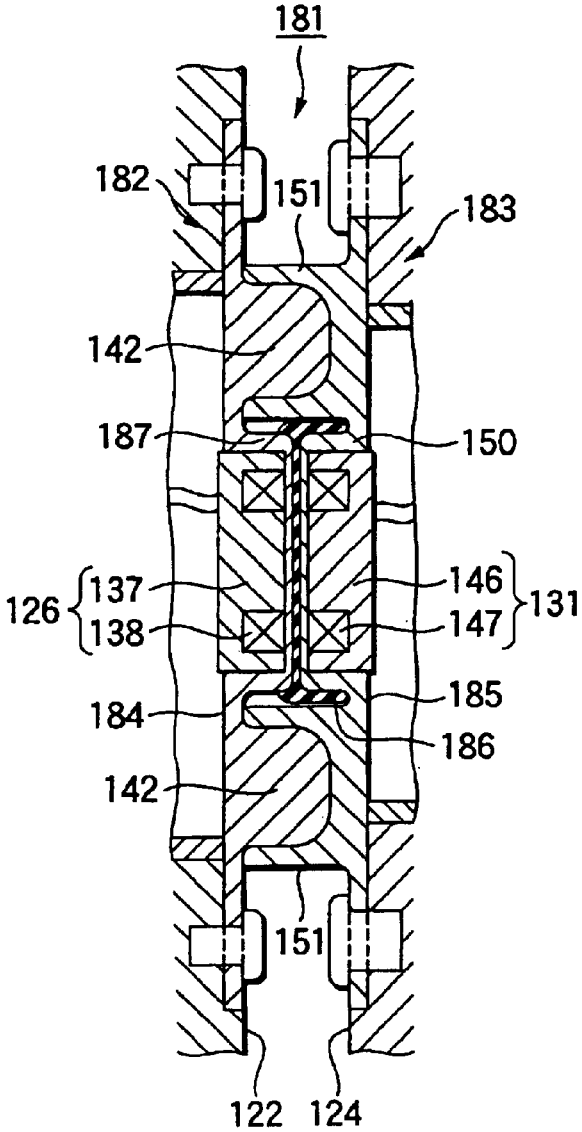
FIG. 26 is across-sectional view explanatory of a coupled condition of the first and second connectors.

Next, an electromagnetic induction-type connector according to a fourth embodiment of the invention will be described with reference to FIGS. 21 to 26. FIG. 21 is a cross-sectional view showing this embodiment. FIG. 22 is a plan view of a first connector of FIG. 21, FIG. 23 is a cross-sectional view taken along the line C—C of FIG. 22, FIG. 24 is a plan view of a second connector of FIG. 21, FIG. 25 is a cross-sectional view taken along the line D—D of FIG. 24, and FIG. 26 is a cross-sectional view showing a coupled condition of the first and second connectors. Those constituent members and portions, identical to those of the above embodiment, will be designated by identical reference numerals, respectively, and detailed explanation thereof will be omitted.

In FIG. 21, reference numeral 181 denotes the electromagnetic induction-type connector. This electromagnetic induction-type connector 181 comprises the first connector 182, provided at a boarding port 122 in a car body of an automobile (corresponding to a first member recited in the claims), and the second connector 183 provided at a peripheral edge portion 124 of a door of the automobile (corresponding to the other of a second member recited in the claims). In the electromagnetic induction-type connector 181 of this embodiment, when the first connector 182 and the second connector 183 are brought into proximity to each other, electric power is supplied from the car body to the door by mutual induction.

The electromagnetic induction-type connector 181 of this embodiment is so designed as to prevent damage due to impingement. And besides, the electromagnetic induction-type connector 181 of this embodiment is so designed as to absorb a misregistration of the first connector 182 or the second connector 183 due to the improper mounting of the door, an aging change or others.

In the electromagnetic induction-type connector 181, a shock-absorbing elastic member 186 (described later) is different in shape and arrangement from that of the above-mentioned electromagnetic induction-type connector 121 (see FIG. 14).

The first connector 182 comprises a first core member 126, and a first covering member 184 covering this first core member 126. A primary coil oscillation drive control device 130, received within a casing 129, is connected to the first connector 182 via wires 128 and 128.

The second connector 183 comprises a second core member 131, which is brought into close proximity to the first core member 126 when the door is closed relative to the car body, a second covering member 185, covering this second core member 131, and the shock-absorbing elastic (resilient) member 186 mounted on the second covering member 185. A known rectifier circuit 136, received within a casing 135, is connected to the second connector 125 via wires 134 and 134.

In FIGS. 21 to 23, the first covering member 184 is made of a synthetic resin, and is formed into a generally flat plate-like shape, and this first covering member 184 is received in a recess 140 in the boarding port 122, and is fixed thereto so as to be opposed to the second connector 183. The first covering member 184 has a first coupling portion 187 (corresponding to a coupling portion recited in the claims), a pair of first fitting portions (positioning projections) 142 and 142 for the second connector 183, and screw passage holes 143 and 143. The first covering member 184 is fixed by bolts 145 and 145 passing respectively through the screw passage holes 143 and 143.

The first coupling portion 187 covers one side of the first core member 126, and a second coupling portion 150 of the second connector 183 (described later) is brought into close proximity to this first coupling portion 187 when the door is closed. In this embodiment, the outer diameter of the first coupling portion 187 is generally equal to the outer diameter of the second coupling portion 150 (described later).

In FIGS. 21, 24 and 25, the second covering member 185 is made of a synthetic resin, and is formed into a generally flat plate-like shape, and this second covering member 185 is received in a recess 149 in the peripheral edge portion 124, and is fixed thereto so as to be opposed to the first connector 182 (and hence the first covering member 184). The second covering member 185 has the second coupling portion 150 (corresponding to a coupling portion recited in the claims), which is brought into proximity to the coupling portion 187 of the first connector 182 when the door is closed, a pair of second fitting portions 151 and 151 (positioning recess portions each having a generally tubular shape with a closed bottom), corresponding respectively to the first fitting portions 142 and 142 of the first connector 182, and screw passage holes 152 and 152. The second covering member 185 is fixed by bolts 154 and 154 passing respectively through the screw passage holes 152 and 152.

In this embodiment, the first covering member 184 and the second covering member 185 are formed such that the first fitting portions 142 and 142 are fitted respectively into the second fitting portions 151 and 151 before the first coupling portion 187 is coupled or joined to the second coupling portion 150. The first covering member 184 and the second covering member 185 are a little smaller in size than the first covering member 127 and the second covering member 132 (see FIG. 14) (Since the outer diameter of the first coupling portion 187 is generally equal to the outer diameter of the second coupling portion 50, the first and second covering members 184 and 185 can be made a little smaller in size.)

In this embodiment, the shock-absorbing elastic member 186 is made of a rubber material, and is formed into a cap-like shape, and is fixed to the second coupling portion 150 by suitable fixing means, such as an adhesive, to cover the distal end surface and peripheral surface of this second coupling portion 150 (Any suitable material, other than rubber, such as a leaf spring and a coil spring, can be used.). The thickness of the shock-absorbing elastic member 186 is so determined that the distal end surface of the first coupling portion 187 and the distal end surface of the second coupling portion 150 is spaced a predetermined distance from each other when the shock-absorbing elastic member 186 is elastically deformed. In this embodiment, although the shock-absorbing elastic member 186 has the cap-like shape, it is not limited to this shape. Namely, any other suitable shape can be adopted in so far as the shock-absorbing elastic member is provided at least on the distal end surface of the second coupling portion.

In the above construction, when the door is closed relative to the car body, the first connector 182 and the second connector 183 are abutted against each other as shown in FIG. 26. At this time, the first fitting portions 142 and 142 are fitted respectively into the second fitting portions 151 and 151, thereby effecting the positioning, and also the shock-absorbing elastic member 186 is brought into contact with the distal end surface of the first coupling portion 187, so that this shock-absorbing elastic member 186 is elastically deformed to absorb an impact. Then, the first coupling portion 187 and the second coupling portion 150 are brought into proximity to each other, and therefore are electromagnetically connected or coupled together. Then, when mutual induction is produced between the primary coil 138 and the secondary coil 147, electric power begins to be supplied from the car body to the door.

Even when the door is abruptly closed relative to the car body, an impact is absorbed by the shock-absorbing elastic member 186. Even if a misregistration of the second connector 183 relative to the first connector 182 is encountered because of the improper mounting of the door, an aging change or others, this misregistration is corrected by the fitting of the first fitting portions 142 and 142 into the respective second fitting portions 151 and 151.

As described above, the shock-absorbing elastic member 186 absorbs an impact, and therefore damage to the first connector 182 and/or the second connector 183 due to impingement is prevented. The shock-absorbing elastic member 186 absorbs the impact while being sandwiched between the first coupling portion 187 and the second coupling portion 150, and therefore particularly damage to the first and second coupling portions 187 and 150 is prevented. And besides, the shock-absorbing elastic member 186 covers the whole of the distal end surface of the second coupling portion 150, and therefore the impact can be absorbed in a stable manner, and damage to the first coupling portion 187 and/or the second coupling portion 150 can be more effectively prevented. Furthermore, the shock-absorbing elastic member 186 is sandwiched between the first coupling portion 187 and the second coupling portion 150, the impingement of the first and second coupling portions 187 and 150 upon each other can be more effectively prevented.

Fifth Embodiment

Figure 27:
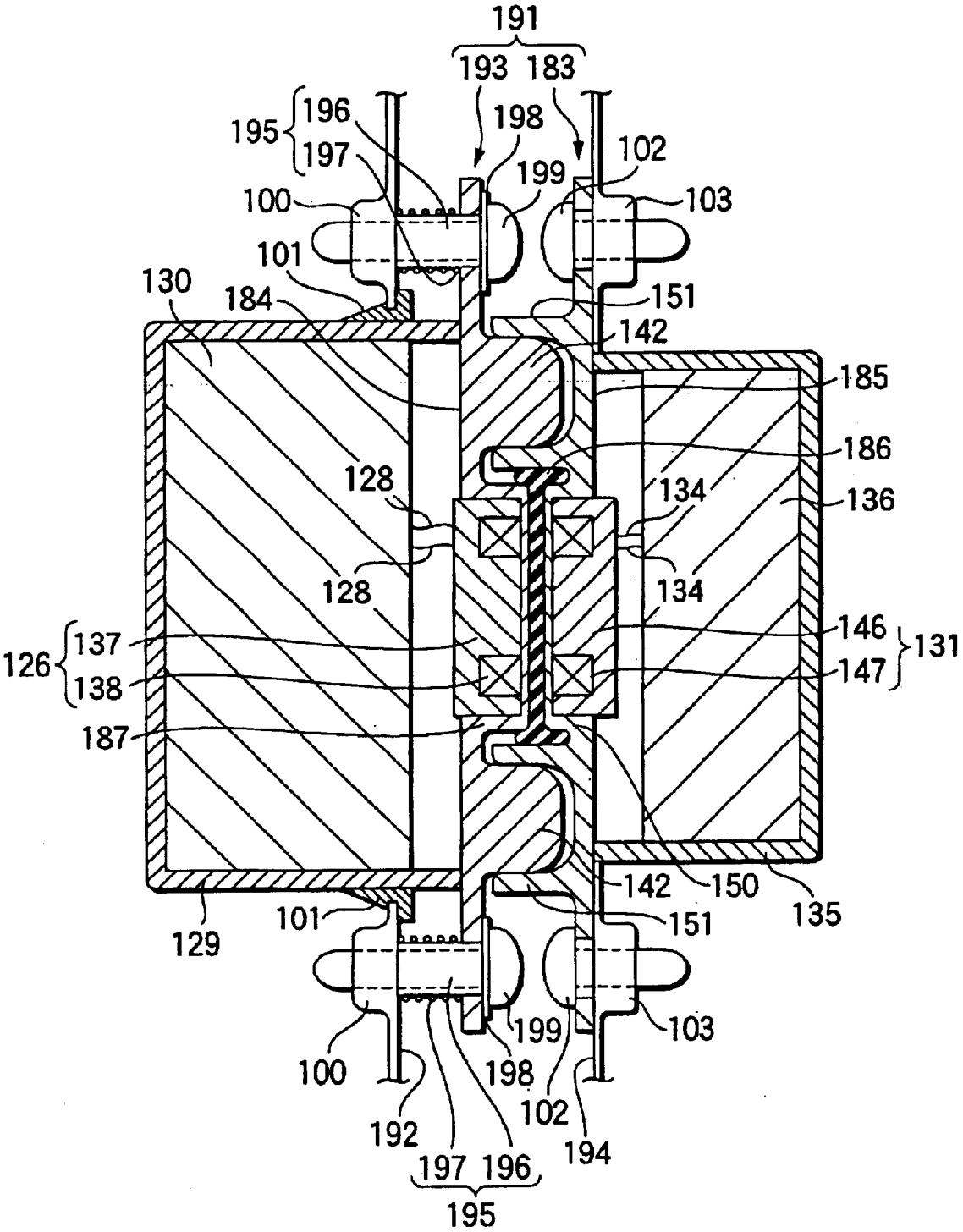
FIG. 27 is a cross-sectional view showing an electromagnetic induction-type connector (when a door is closed in a normal manner) according to a fifth embodiment of the present invention.
Figure 28:
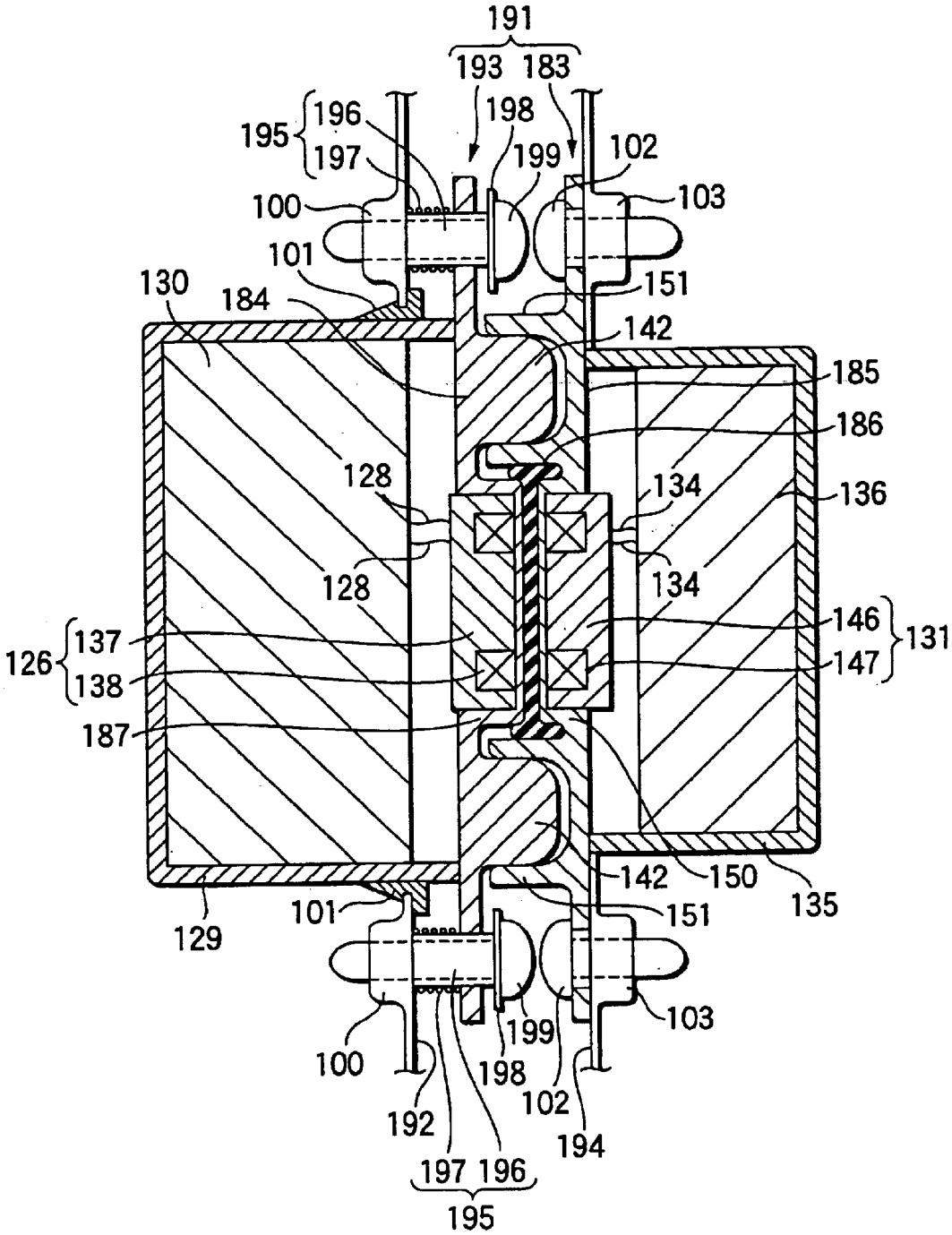
FIG. 28 is a cross-sectional view similar to FIG. 27, but showing a condition when the door is abruptly closed.

Next, an electromagnetic induction-type connector according to a fifth embodiment of the invention will be described with reference to FIGS. 27 and 28. FIG. 27 is a cross-sectional view showing this embodiment (when a door is closed in a normal manner), and FIG. 28 is a cross-sectional view similar to FIG. 27, but showing a condition when the door is abruptly closed. Those constituent members and portions, identical to those of the above embodiments, will be designated by identical reference numerals, respectively, and detailed explanation thereof will be omitted.

In FIGS. 27 and 28, reference numeral 191 denotes the electromagnetic induction-type connector. This electromagnetic induction-type connector 191 comprises a first connector 193, retractably and returnably provided at a boarding port 192 in a car body of an automobile (corresponding to a first member recited in the claims), and a second connector 183 provided at a peripheral edge portion 194 of a door of the automobile (corresponding to a second member recited in the claims). The electromagnetic induction-type connector 191 of this embodiment differs from the above-mentioned electromagnetic induction-type connector 181 (see FIG. 21) in that resilient members 195 and 195 (described later) are provided at the first connector 193.

The first connector 193 comprises a first core member 126, and a first covering member 184, and the pair of resilient members 195 and 195. A primary coil oscillation drive control device 130, received within a casing 129, is connected to the first connector 193 via wires 128 and 128. A known rectifier circuit 136, received within a casing 135, is connected to the second connector 183 via wires 134 and 134.

When a pressing force above a predetermined value is applied to the resilient members 195 and 195 upon contact of the first and second connectors 193 and 183 with each other, the resilient members 195 and 195 are resiliently deformed. Each of the resilient members 195 and 195 comprises a cylindrical tubular spacer 196, passing through a corresponding screw passage hole 143 in the first covering member 184, and a coil spring 197 wound around the spacer 196 (The resilient members 195 and 195 may be provided at the second connector 183.).

A flange 198 is formed at one end of each of the spacers 196 and 196, and limits the forward movement of the first covering member 184. The other end of each spacer 196 is abutted against the boarding port 192. Reference numerals 199 and 199 denote bolts, respectively, and these bolts are passed respectively through the spacers 196 and 196, and are threaded respectively into threaded portions 100 and 100 formed at the boarding port 192. The coil springs 197 and 197 act between the first covering member 184 and the boarding port 192, and urge the first covering member 184 forward.

Reference numeral 101 denotes a guide portion provided at the boarding port 192. In accordance with the retracting movement of the first connector 193, the casing 129 slides relative to the guide portion 101. In this embodiment, lubricant, such as grease, is coated in order to enhance a waterproof effect.

The second connector 183 is fixedly secured to the peripheral edge portion 194 by bolts 102 and 102 threaded respectively into threaded portions 103 and 103 formed at the peripheral edge portion 194.

In the above construction, when the door is closed relative to the car body in a normal manner, the first connector 193 and the second connector 183 are abutted against each other as shown in FIG. 27. At this time, first fitting portions 142 and 142 are fitted respectively into second fitting portions 151 and 151, thereby effecting the positioning, and also shock-absorbing elastic member 186 is brought into contact with a distal end surface of a first coupling portion 187, so that this shock-absorbing elastic member 186 is elastically deformed to absorb an impact. Then, the first coupling portion 187 and a second coupling portion 150 are brought into proximity to each other, and therefore are electromagnetically connected or coupled together. At this time, if the first coupling portion 187 an the second coupling portion 150 are not spaced a predetermined distance from each other, the coil springs 197 and 197 of the resilient members 195 and 195 are resiliently deformed to retract the first connector 193, thereby keeping the distance between the first and second coupling portions to the predetermined value (This function is achieved particularly when the door is abruptly closed as shown in FIG. 28.). Then, when mutual induction is produced between a primary coil 138 and a secondary coil 147, electric power begins to be supplied from the car body to the door.

As described above, the electromagnetic induction-type connector 191 of this embodiment achieves not only the effects of the above electromagnetic induction-type connector 181 (see FIG. 21) but also the effect or advantage that the first connector 193 is retracted so as to keep the distance between the first coupling portion 187 and the second coupling portion 150 to the predetermined value. Therefore, the power supply efficiency can be made stable. And besides, this construction contributes to the prevention of damage.

Various modifications can be made within the scope of the invention. Namely, although the first and second members recited in the claims are the car body and the door body (the door, the slide door and the rear hatch), respectively, the two members are not limited to these. For example, a tuner and a speaker of an audio equipment can be used as such two members, respectively. Other examples include a steering of a door (separate side: a steering portion), and a seat of an automobile (separate side: a seat portion). The invention can be applied to any suitable two members in so far as electric power need to be supplied from one of the two members to the other. In the above embodiments, although the supply of electric power has been described, the invention can be used for transferring a signal.

As described above, in the invention, the shock-absorbing resilient member contacts absorbs an impact, and therefore damage of the first connector and/or the second connector due to impingement can be prevented.

In the invention, an impact can be absorbed in the vicinity of the coupling portion of one of the first and second connectors. Therefore, particularly, damage to the coupling portion can be prevented.

In the invention, the shock-absorbing resilient member is disposed in surrounding relation to the coupling portion, and therefore an impact can be absorbed in a stable manner. And besides, the transmission of the impact to the coupling portion is suppressed. Therefore, damage to the coupling portion is prevented more effectively.

In the invention, the impingement of the coupling portions of the two connectors upon each other can be prevented more effectively.

In the invention, an impact can be absorbed at the coupling surface of the coupling portion of one of the first and second connectors. Therefore, particularly, damage to the coupling portion is prevented.

In the invention, the two coupling portions can be kept spaced the predetermined distance from each other, and the power supply efficiency or the signal transfer efficiency can be stabilized. And besides, this contributes to the prevention of damage.

Sixth Embodiment

Figure 29:
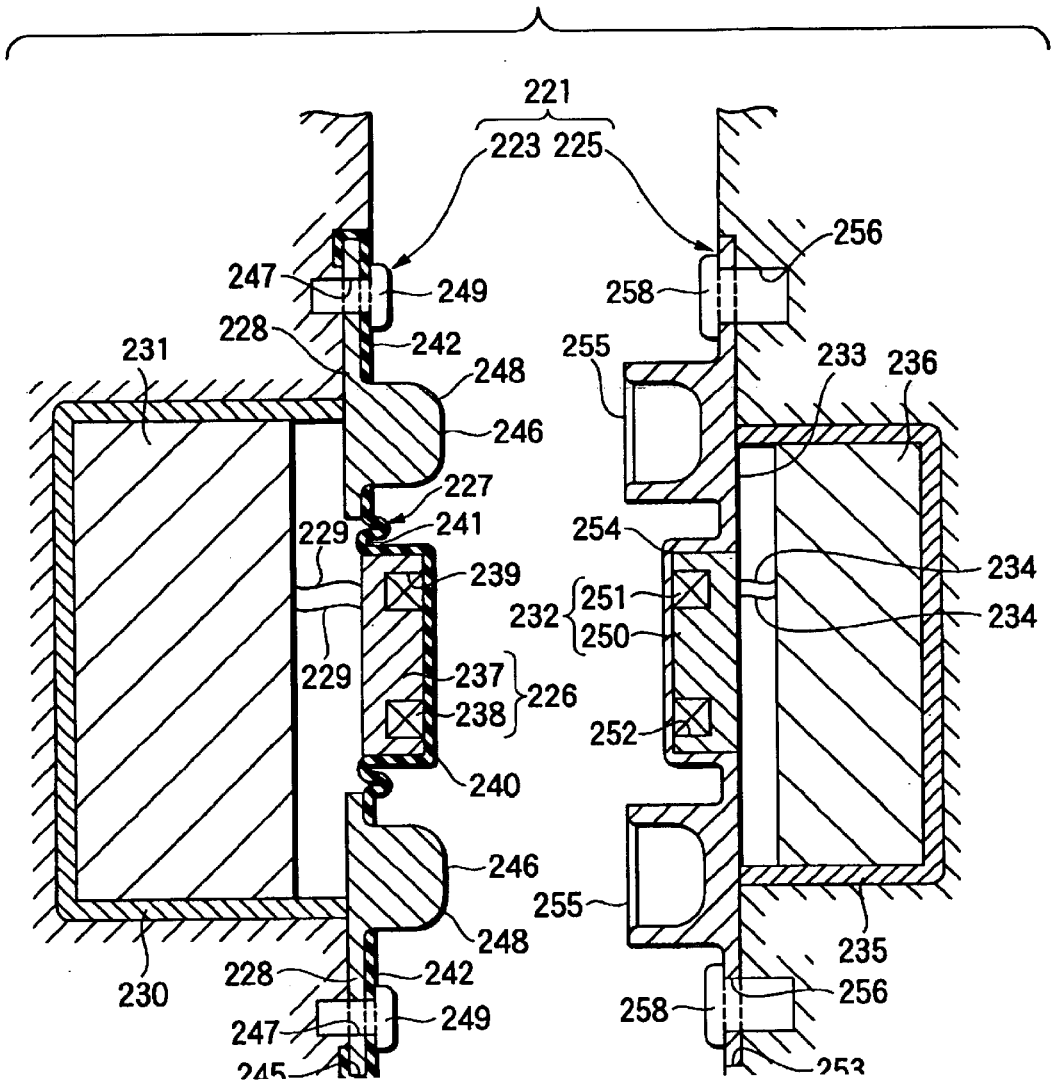
FIG. 29 is a cross-sectional view showing an electromagnetic induction-type connector according to a sixth embodiment of the present invention.
Figure 30:
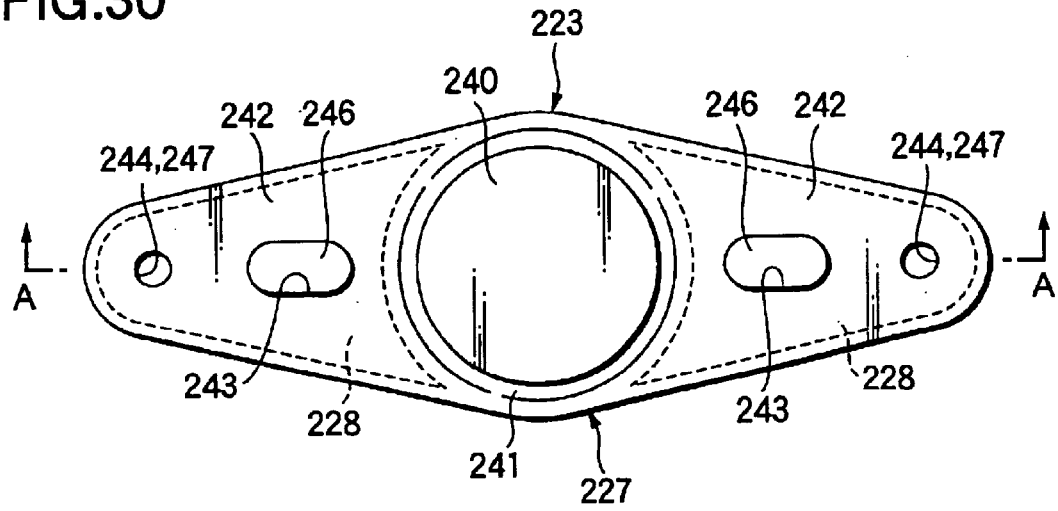
FIG. 30 is a plan view of a first connector of FIG. 29.
Figure 31:
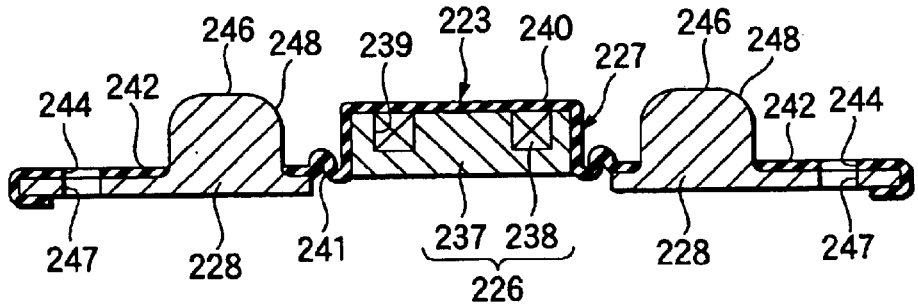
FIG. 31 is a cross-sectional view taken along the line A—A of FIG. 30.
Figure 32:
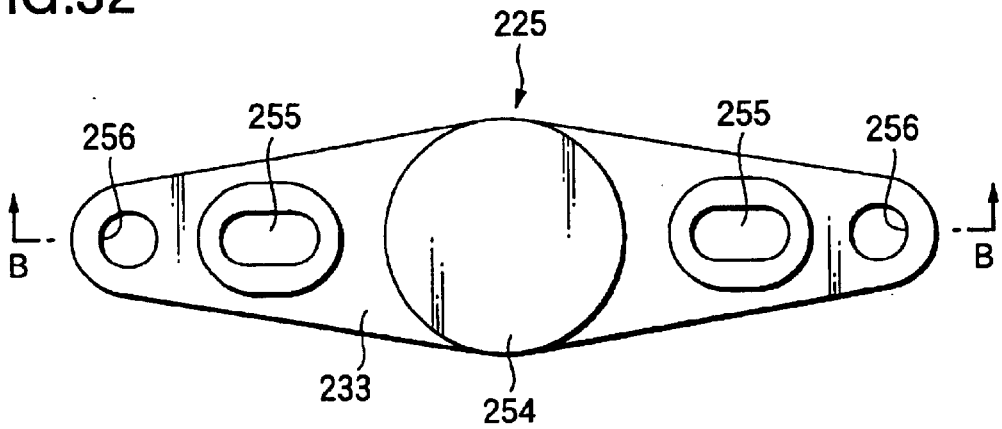
FIG. 32 is a plan view of a second connector of FIG. 29.
Figure 33:
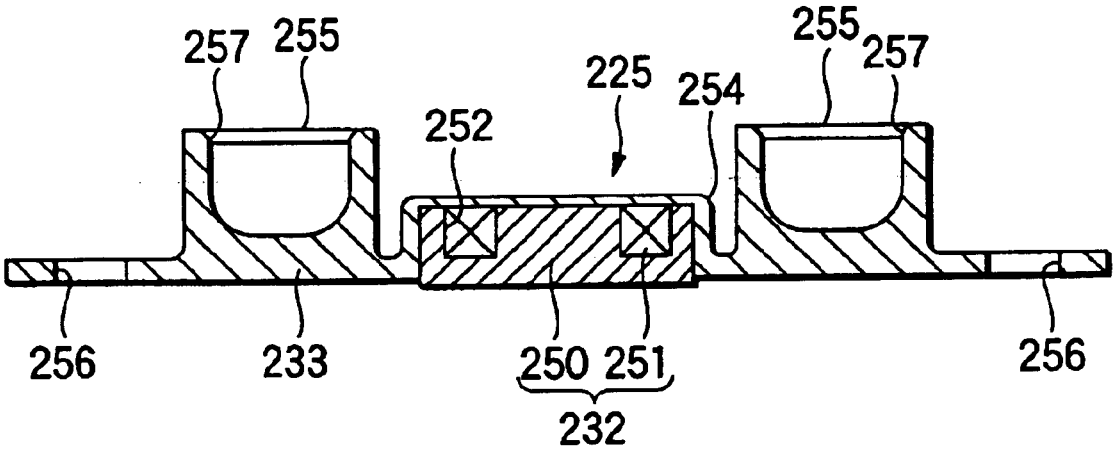
FIG. 33 is a cross-sectional view taken along the line B—B of FIG. 32.
Figure 34:
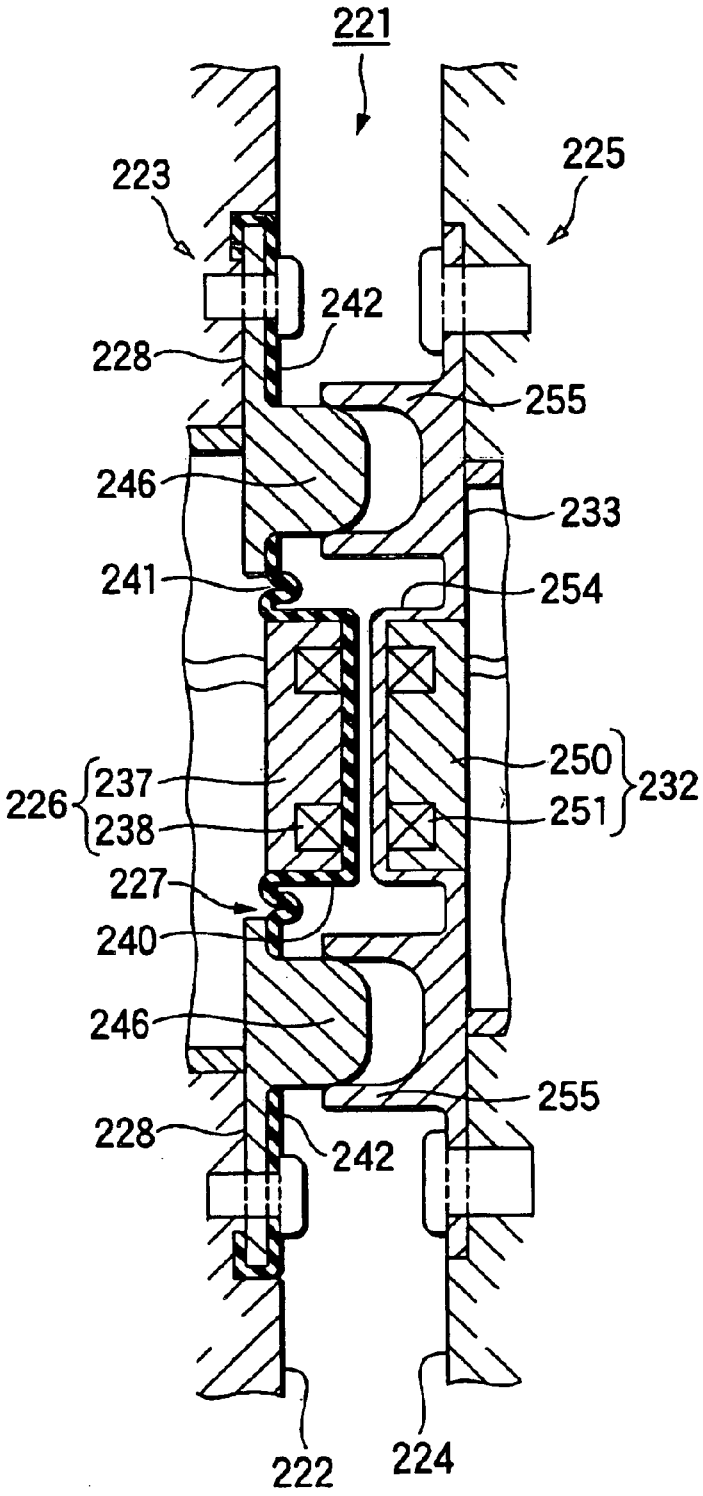
FIG. 34 is a cross-sectional view explanatory of a coupled condition of the first and second connectors (when a door is closed in a normal manner).
Figure 35:
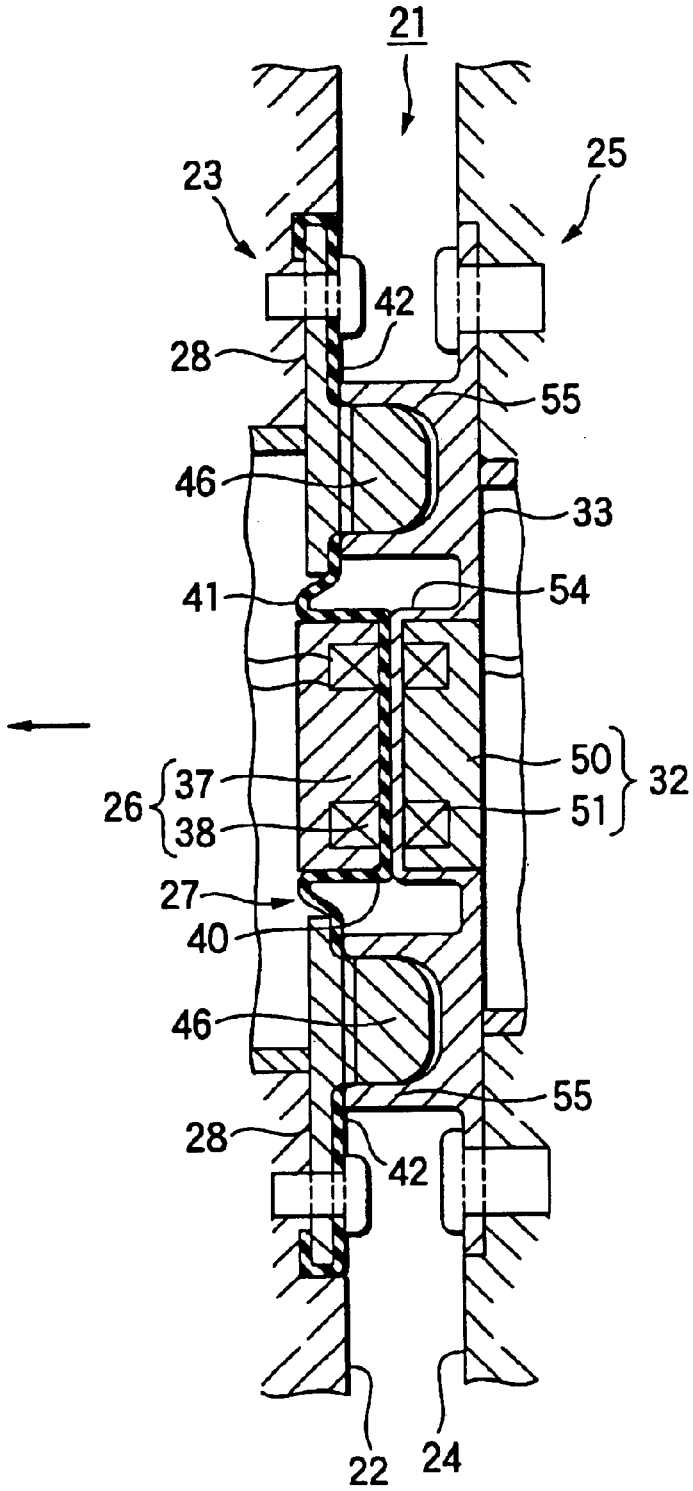
FIG. 35 is a cross-sectional view explanatory of the coupled condition of the first and second connectors (when the door is closed abruptly).

FIG. 29 is a cross-sectional view showing an electromagnetic induction-type connector according to a sixth embodiment of the present invention. FIG. 30 is a plan view of a first connector, FIG. 31 is a cross-sectional view taken along the line A—A of FIG. 30, FIG. 32 is a plan view of a second connector, FIG. 33 is a cross-sectional view taken along the line B—B of FIG. 32, FIG. 34 is a cross-sectional view explanatory of a coupled condition of the first and second connectors (when a door is closed in a normal manner), and FIG. 35 is a cross-sectional view explanatory of the coupled condition of the first and second connectors (when the door is closed abruptly).

In FIG. 29, reference numeral 221 denotes the electromagnetic induction-type connector. This electromagnetic induction-type connector 221 comprises the first connector 223, provided at a boarding port 222 in a car body of an automobile (corresponding to a first member recited in the claims), and the second connector 225 provided at a peripheral edge portion 224 of a door of the automobile (corresponding to a second member recited in the claims). In the electromagnetic induction-type connector 221 of this embodiment, when the first connector 223 and the second connector 225 are brought into proximity to each other, electric power is supplied from the car body to the door by mutual induction.

The electromagnetic induction-type connector 221 of this embodiment is so designed as to prevent damage due to impingement. And besides, the electromagnetic induction-type connector 221 of this embodiment is so designed as to absorb a misregistration of the first connector 223 or the second connector 225 due to the improper mounting of the door, an aging change or others.

The first connector 223 comprises a first core member 226, and an elastic member 227, and a pair of fixing members 228. A primary coil oscillation drive control device 231, received within a casing 230, is connected to the first connector 223 via wires 229 and 229. The primary coil oscillation drive control device 231 has the function of an inverter, and controls the exciting of a primary coil 238 (described later).

The second connector 225 comprises a second core member 232, which is brought into close proximity to the first core member 226 when the door is closed relative to the car body, and a covering member 233, covering this second core member 232. A known rectifier circuit 236, received within a casing 235, is connected to the second connector 225 via wires 234 and 234.

First, the first connector 223 will be described in further detail with reference to FIGS. 29 to 31.

The first core member 226 comprises a primary core 237, and a primary coil 238. The primary core 237 is formed, for example, by sintering ferrite powder, and this primary core 237 has an annular groove 239 of a channel-shaped cross-section formed in one side thereof. The primary coil 238 is formed by winding a wire, and this primary coil 238 is received in the annular groove 239.

The elastic member 227 is made of a rubber material. The elastic member 227 includes a waterproof covering portion 240, covering the first core member 226, a resilient portion 241 for enabling the retraction of the first core member 226, and fixing member-connecting portions 242 and 242 connected respectively to the fixing portions 228 and 228 to generally cover these fixing portions 228 and 228.

The waterproof covering portion 240 has a generally cap-shape, and covers the one side (face) and peripheral surface of the first core member 226 in a watertight manner. A coupling portion 254 (described later) of the second connector 225 is brought into proximity to this waterproof covering portion 240 when the door is closed. The waterproof covering portion 240 is fixedly secured to the first core member 226 by an adhesive or the like. This waterproof covering portion 240 protects the first core member 226, and dampens an impact upon contact. In this embodiment, a distal end surface of the waterproof covering portion 240 projects beyond the boarding port 222 (However, it is not limited to this arrangement. Namely, this distal end surface may be disposed flush with the boarding port 222.).

The resilient portion 241 is formed watertight on the outer peripheral surface of the waterproof covering portion 240 at an open end thereof over the entire periphery thereof. The resilient portion 241 is formed into such a shape (see the shape shown in the drawings) that the resilient portion 241 is elastically deformed when a pressing force is applied thereto from the second connector 225, and that the resilient portion 241 is restored into its original condition when the application of this pressing force is canceled. In other words, when the pressing force from the second connector is applied, the resilient portion 241 allows the first core member 226 to retract, and when the application of this pressing force is canceled, the resilient portion 241 returns the first core member 226 to its original position.

The fixing member-connecting portions 242 and 242 are formed integrally with and extends from the resilient portion 241 in a watertight manner. A peripheral edge portion of each of the fixing member-connecting portions 242 and 242 is turned back on the reverse side of the corresponding fixing member 228, so that a watertight condition is maintained. In this embodiment, each of the fixing member-connecting portions 242 and 242 has a first fitting portion 246 (described later), a through hole 244, aligned with a screw passage hole 247, and a through hole 243.

Each of the fixing members 228 and 228 is made of a synthetic resin, and is formed into a generally flat plate-like shape, and is received in a recess 245 in the boarding port 222 so as to be opposed to the second connector 225. Each fixing member 228 has the first fitting portion 246, and the screw passage hole 247. In this embodiment, the fixing members 28 and 28 serve as members to which the elastic member 227 is connected, and the fixing members 228 and 228 also serve to fix the first connector to the boarding port 222.

Each of the first fitting portions 246 and 246 is a projection for positioning the first connector relative to the second connector 225, and a curved surface 248 is formed at a distal end portion of the first fitting portion 246 over an entire periphery thereof (In the case where each of the first fitting portions 246 and 246 is a recess portion, each of second fitting portions 255 and 255 (described later) is a projection.) Each first fitting portion 246 is elongate in the direction of the length of the fixing member 228 (The curved surface 248 is formed at least in a direction in which the door is deviated from the proper position). The two first fitting portions are disposed respectively at opposite sides of the first core member 226 in such a manner that the first core member 226 is interposed between the two first fitting portions (The number of the first fitting portions 246 is not limited to two, but may be three or more. Preferably, these first fitting portions are disposed near to the first core member 226 in order to enhance the positioning precision.).

Reference numerals 249 and 249 denote bolts for passing respectively through the screw passage holes 247 and 247. The bolts 249 and 249 are threaded respectively into threaded portions formed in the recess portion 245 in the boarding port 222.

Next, the second connector 225 will be described in further detail with reference to FIGS. 29, 32 and 33.

The second core member 232 comprises a secondary core 250, and a secondary coil 251. The secondary core 250 is formed, for example, by sintering ferrite powder, and has an annular groove 252 of a channel-shaped cross-section formed in one side thereof. The secondary coil 251 is formed by winding a wire, and is received in the annular groove 252.

The covering member 233 is made of a synthetic resin, and is formed into a generally flat plate-like shape, and this covering member 233 is received in a recess 253 in the peripheral edge portion 224, and is fixed thereto so as to be opposed to the first connector 223. The covering member 233 has the coupling portion 254, the pair of second fitting portions 255 and 255, and screw passage holes 256 and 256.

The coupling portion 254 covers one side of the second core member 232, and is brought into close proximity to (or into contact with) the waterproof covering portion 240 of the first connector 223 when the door is closed. In this embodiment, a distal end surface of the coupling portion 254 projects beyond the peripheral edge portion 224 (However, it is not limited to this arrangement, and this distal end surface maybe disposed flush with the peripheral edge portion 224.).

Each of the second fitting portions 255 and 255 is a positioning recess portion (having a generally tubular shape with a closed bottom), corresponding to the first fitting portion 246 of the first connector 223, and a curved surface 257 is formed on an inner surface of the second fitting portion 255 at a distal end thereof over an entire periphery thereof. Each second fitting portion 255 is elongate in the direction of the length of the covering member 233 (The curved surface 257 is formed at least in a direction in which the door is deviated from the proper position). The two second fitting portions are disposed respectively at opposite sides of the coupling portion 254 in such a manner that the coupling portion 254 is interposed between the two second fitting portions (The number of the second fitting portions 255 is not limited to two, but may be three or more. Preferably, these second fitting portions are disposed near to the coupling portion 254 in order to enhance the positioning precision.).

Reference numerals 258 and 258 denote bolts for passing respectively through the screw passage holes 256 and 256. The bolts 258 and 258 are threaded respectively into threaded portions formed in the recess portion 253 in the peripheral edge portion 224.

In this embodiment, the elastic member 227 and the covering member 233 are formed such that the first fitting portions 246 and 246 are fitted respectively into the second fitting portions 255 and 255 before the waterproof covering portion 240 is coupled or joined to the coupling portion 254 (that is, the first core member 226 and the second core member 232 are electromagnetically coupled together).

In the above construction, when the door is closed relative to the car body, the first connector 223 and the second connector 225 are abutted against each other as shown in FIG. 34. At this time, the first fitting portions 246 and 246 are fitted respectively into the second fitting portions 255 and 255, thereby effecting the positioning, and also the waterproof covering portion 240 and the coupling portion 254 are brought into proximity to each other, so that the two core members are electromagnetically coupled together. Then, when mutual induction is produced between the primary coil 238 and the secondary coil 251, electric power begins to be supplied from the car body to the door.

Even when the door is abruptly closed relative to the car body, so that the coupling portion 254 is brought into contact with the waterproof covering portion 240 as shown in FIG. 35, the waterproof covering portion 240 and the first core member 226 are retracted through the resilient portion 241, and an impact, produced by this contact, is absorbed.

Even if a misregistration of the second connector 225 relative to the first connector 223 is encountered because of the improper mounting of the door, an aging change or others, this misregistration is corrected by the fitting of the first fitting portions 246 and 246 into the respective second fitting portions 255 and 255 (The electromagnetic coupling is secured. This construction is useful since the conventional connector is not provided with any means for absorbing such misregistration.).

As described above, even when the coupling portion 254 is brought into contact with the waterproof covering portion 240, the waterproof covering portion 240 and the first core member 226 are retracted through the resilient portion 241, and an impact, produced by this contact, is absorbed. Therefore, damage of the first connector 223 and/or the second connector 225 due to impingement can be prevented. And besides, although the waterproof covering portion 240 and the first core member 226 can be retracted, water is prevented from intruding through such retracting portions.

This connector does not have any permanent magnet as used in the conventional construction, and therefore is free from adverse effects of iron powder (In the conventional connector, when iron powder adhered to the connector, the iron powder remained deposited thereon, which invited a possibility that the electromagnetic coupling could not be effected.). This connector has another advantage that the construction can be simplified.

Figure 36:
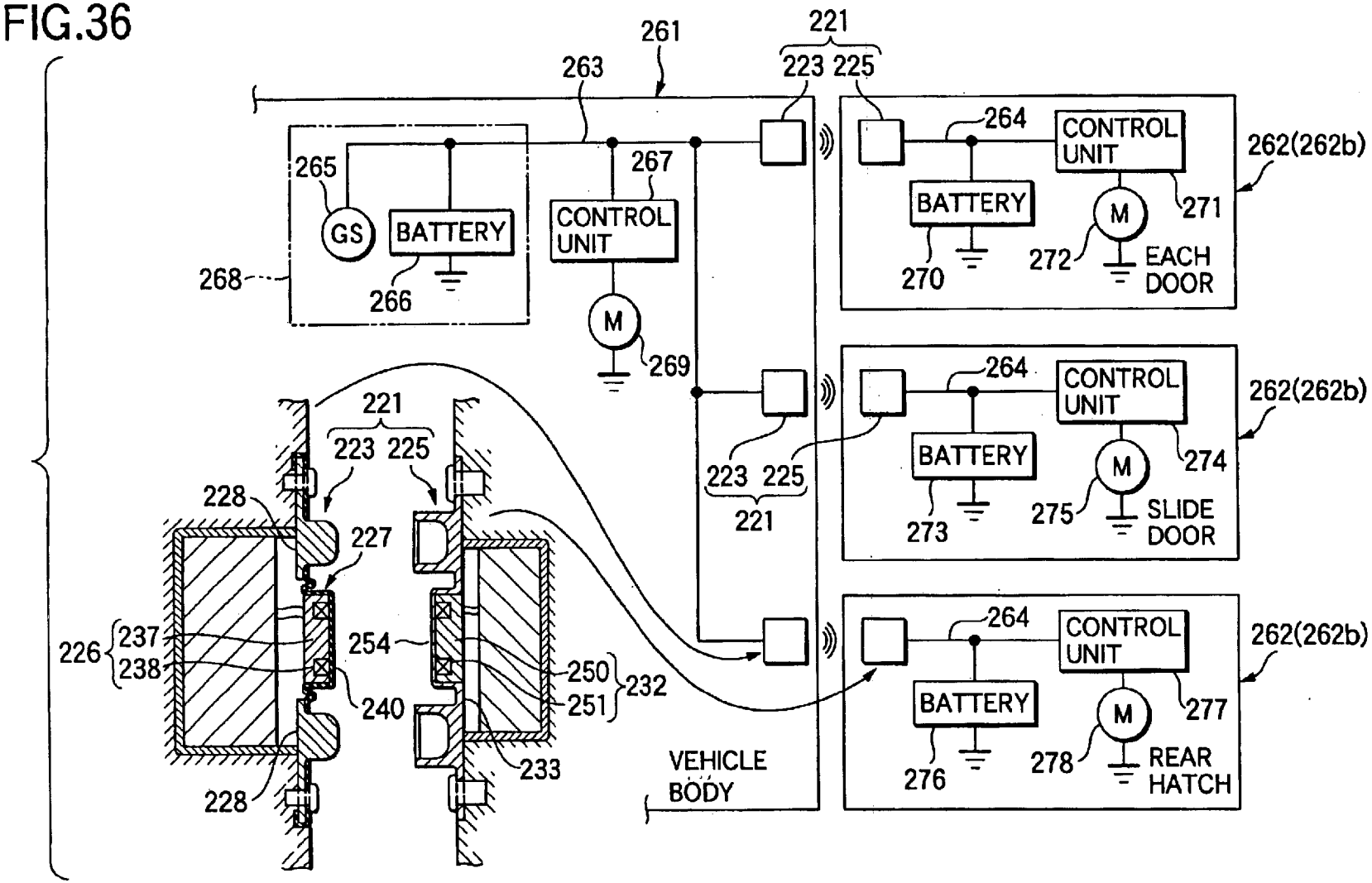
FIG. 36 is a block diagram of one example of an electric power supply system for an automobile, provided with the electromagnetic induction-type connectors of FIG. 29.
Figure 37:
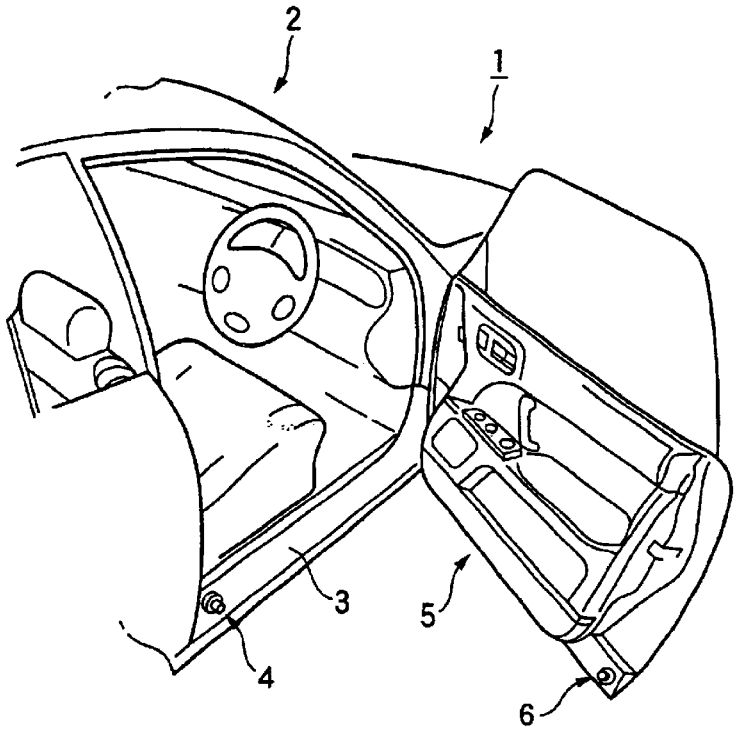
FIG.37 PRIOR ART
FIG. 37 is a perspective view showing a side portion of an automobile provided with a related connector.
Figure 38:
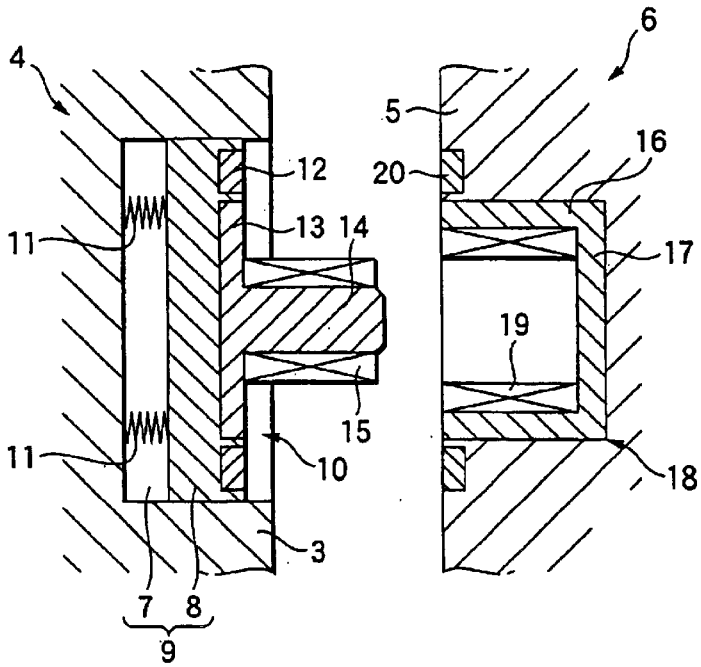
FIG.38 PRIOR ART
FIG. 38 is a cross-sectional view of the related electromagnetic induction-type connector.

One example of an electric power supply system for an automobile, provided with the above electromagnetic induction-type connectors 221, will be described with reference to FIG. 36. FIG. 36 is a block diagram thereof.

In FIG. 36, a plurality of door bodies 262 are mounted on a car body 61 of the automobile so as to be opened and closed relative to this car body 261. The electromagnetic induction-type connector 221 for supplying electric power from the car body 261 to each door body 262 by mutual induction is provided at a door-connecting portion between the car body 261 and each of the door bodies 262. The number of the electromagnetic induction-type connectors 221 corresponds to the number of the door bodies 262, and each of these connectors 221 comprises the first connector 223, mounted on the car body 261, and the second connector 225 mounted on the corresponding door body 262. The first connector 223 is connected to a power supply line 263 provided at the car body 261, and the second connector 225 is connected to a power supply line 264 provided at the corresponding door body 262.

The door bodies 262 are a driver's seat-side door 262*a*, an assistant driver's seat-side door 262*a*, a slide door 262*b*, and a rear hatch 262*c*, respectively. The car body 261 is the first member recited in the claims while the door body 262 is the second member recited in the claims.

The construction of each of the above parts will be described. In addition to the first connectors 223 and the power supply line 263, a generator 265, a battery 266, a control unit 267 and soon are mounted on the car body 261. The generator 265 and the battery 266 are mounted within an engine room 268, and the battery 266 is charged with electric power produced by the generator 265. The power supply line 263 is connected to the battery 266, and electric power is supplied from this battery to the control unit 267. For example, a motor 269 is connected to the control unit 267.

The oscillation (driving) of each first connector 223 is controlled by the primary coil oscillation drive control device 231 (not shown here. See FIG. 29) connected to the power supply line 263.

In addition to the second connector 225 and the power supply line 264, a battery 270, a control unit 271 and so on are mounted on the door 262*a*. The battery 270 is charged with an induction electromotive force, produced in the second connector 225, via a rectifier circuit (not shown) and a charging circuit (not shown). The power supply line 264 is connected to the battery 270. The control unit 271 is connected to the power supply line 264, and is supplied with electric power from this power supply line. For example, a motor 272 is connected to the control unit 271.

In addition to the second connector 225 and the power supply line 264, a battery 273, a control unit 274 and so on are mounted on the door 262*b*. The battery 273 is charged with an induction electromotive force, produced in the second connector 225, via a rectifier circuit (not shown) and a charging circuit (not shown). The power supply line 264 is connected to the battery 273. The control unit 274 is connected to the power supply line 264, and is supplied with electric power from this power supply line. For example, a motor 275 is connected to the control unit 274.

In addition to the second connector 225 and the power supply line 264, a battery 276, a control unit 277 and so on are mounted on the rear hatch 262*c*. The battery 276 is charged with an induction electromotive force, produced in the second connector 25, via a rectifier circuit (not shown) and a charging circuit (not shown). The power supply line 264 is connected to the battery 276. The control unit 277 is connected to the power supply line 264, and is supplied with electric power from this power supply line. For example, a motor 278 is connected to the control unit 277.

In the above construction, each electromagnetic induction-type connector 221 operates in the following manner. First, when a key (not shown) is inserted into an ignition switch, and turns on this ignition switch, electric power is supplied to each primary coil oscillation drive control device 231 (not shown here. See FIG. 29) connected to the power supply line 263. When electric power is thus supplied to the primary coil oscillation drive control device 231 (not shown here. See FIG. 29), the primary coil 238 of each first connector 223 is driven or oscillated by the primary coil oscillation drive control device 231 (not shown here. See FIG. 29), so that an AC electromotive force is produced in the primary coil 238.

When the door 262*a* is closed relative to the car body 261, an induction electromotive force is produced in the secondary coil 251 through mutual induction between the primary coil 238 and the secondary coil 251. The battery 270 is charged with the thus produced induction electromotive force via the rectifier circuit (not shown) and the charging circuit (not shown). When the door 262*a* is open relative to car body 261, electric power is supplied from the battery 270 to the power supply line 264.

When the slide door 262*b* is closed relative to the car body 261, an induction electromotive force is produced in the secondary coil 251 through mutual induction between the primary coil 238 and the secondary coil 251. The battery 273 is charged with the thus produced induction electromotive force via the rectifier circuit (not shown) and the charging circuit (not shown). When the slide door 262*b* is open relative to car body 261, electric power is supplied from the battery 273 to the power supply line 264.

When the rear hatch 262*c* is closed relative to the car body 261, an induction electromotive force is produced in the secondary coil 251 through mutual induction between the primary coil 238 and the secondary coil 251. The battery 276 is charged with the thus produced induction electromotive force via the rectifier circuit (not shown) and the charging circuit (not shown). When the rear hatch 262*c* is open relative to car body 261, electric power is supplied from the battery 276 to the power supply line 264.

Various modifications can be made within the scope of the invention. Namely, although the two members, recited in the claims, are the car body and the door body (the door, the slide door and the rear hatch), respectively, the two members are not limited to these. For example, a tuner and a speaker of an audio equipment can be used as such two members, respectively. Other examples include a steering of a door (separate side: a steering portion), and a seat of an automobile (separate side: a seat portion). The invention can be applied to any suitable two members in so far as electric power need to be supplied from one of the two members to the other.

In the above embodiment, although the supply of electric power has been described, the invention can be used for transferring a signal. In the above embodiment, the first connector 223 includes the elastic member 227, and the pair of fixing members 228 and 228. However, instead of forming the first connector into such a construction, the second connector 225 may be formed into such a construction. In the above embodiment, although the waterproof covering portion 240 of the elastic member 227 covers the first core member 226, the invention is not limited to this construction. For example, a waterproof portion (similar to the coupling portion 254 of the second connector 225) may be provided on the first core member 226, in which case the resilient portion 241 of the elastic member 227 is connected watertight to this waterproof portion.

As described above, in the invention, one of the first and second core members can be retracted through the elastic member. Therefore, damage of the first connector and/or the second connector due to impingement can be prevented.

In the invention, even when the (first or second) core member is retracted, water is prevented from intruding through such retracting portion.

In the invention, even when the (first or second) core member is retracted, water is prevented from intruding through such retracting portion.

What is claimed is:

1. An electromagnetic induction-type connector comprising:

a first connector on a first member which includes a first core member, and a first fitting portion; and a second connector on a second member adapted to be brought into proximity to the first member, which includes a second core member for producing an induction electromotive force in cooperation with the first core member, and a second fitting portion, for positioning the second connector with respect to the first connector, fitted to the first fitting portion when the second connector is brought into proximity of the first member, wherein electric power or a signal is transmitted between the first connector and the second connector by mutual induction effect when the second member is brought into proximity to the first member, wherein a shock-absorbing resilient member which can be resiliently deformed when the first fitting portion is fitted to the second fitting portion is provided at at least one of the first fitting portion and the second fitting portion.

2. The electromagnetic induction-type connector according to claim 1, wherein a plurality of the first fitting portions and a plurality of the second fitting portions are provided at the first and second connectors, respectively.

3. The electromagnetic induction-type connector according to claim 2, wherein the plurality of first fitting portions are disposed at opposite sides of the first core member in such a manner that the first core member is interposed between the plurality of first fitting portions, and the plurality of second fitting portions are disposed at opposite sides of the second core member in such a manner that the second core member is interposed between the plurality of second fitting portions.

4. The electromagnetic induction-type connector according to claim 1, wherein the first fitting portion is a recess and the second fitting portion is a projection to be inserted into the recess.

5. The electromagnetic induction-type connector according to claim 4, wherein the recess includes a first tapering surface and the projection includes a second tapering surface slidable along the first tapering surface.

6. An electromagnetic induction-type connector comprising:

a first connector on a first member which includes a first core member, and a first fitting portion; and a second connector on a second member adapted to be brought into proximity to the first member, which includes a second core member for producing an induction electromotive force in cooperation with the first core member, and a second fitting portion, for positioning the second connector with respect to the first connector, fitted to the first fitting portion when the second connector is brought into proximity of the first member, wherein electric power or a signal is transmitted between the first connector and the second connector by mutual induction effect when the second member is brought into proximity to the first member, wherein a shock-absorbing resilient member which can be resiliently deformed when the first fitting portion is fitted to the second fitting portion is provided at one of the first and second core members.

7. An electromagnetic induction-type connector comprising:

a first connector on a first member which includes a first core member, and a first fitting portion; and a second connector on a second member adapted to be brought into proximity to the first member, which includes a second core member for producing an induction electromotive force in cooperation with the first core member, and a second fitting portion, for positioning the second connector with respect to the first connector, fitted to the first fitting portion when the second connector is brought into proximity of the first member, wherein electric power or a signal is transmitted between the first connector and the second connector by mutual induction effect when the second member is brought into proximity to the first member, wherein one of the first and second connectors includes an elastic member for allowing the first or second core member of the one of the first and second connectors to retract upon contact between the first and second connectors.

8. The electromagnetic induction-type connector according to claim 1, wherein the first core member includes a primary core and a primary coil, and the second core member includes a secondary core and a secondary coil.

9. An electromagnetic induction-type connector comprising:

a first connector on a first member;

a second connector on a second member adapted to be brought into proximity to the first member for producing an induction electromotive force in cooperation with the first connector when the first member is brought into proximity of the second member; and a shock-absorbing resilient member, which can be resiliently deformed upon a contact between the first and second connectors, provided at one of the first and second core members, wherein electric power or a signal is transmitted between the first connector to the second connector by mutual induction effect when the second member is brought into proximity to the first member.

10. The electromagnetic induction-type connector according to claim 9, wherein the shock-absorbing resilient member is provided in the vicinity of a coupling portion of the one of the first and second connectors which cooperates with the other of the first and second connectors to produce the mutual induction.

11. The electromagnetic induction-type connector according to claim 10, wherein the shock-absorbing resilient member surrounds the coupling portion.

12. The electromagnetic induction-type connector according to claim 10, wherein the shock-absorbing resilient member is provided so as to be brought into contact with a coupling surface of a coupling portion of the other of the first and second connectors which produces the mutual induction.

13. The electromagnetic induction-type connector according to claim 9, wherein the shock-absorbing resilient member is provided in the vicinity of a coupling surface of a coupling portion of the one of the first and second connectors which cooperates with the other of the first and second connector to produce the mutual induction.

14. The electromagnetic induction-type connector according to claim 9, wherein a resilient member is provided on one of the first connector and the second connector, and when a pressing force above a predetermined value is applied to the resilient member by the contact, the resilient member is resiliently deformed, thereby enabling the one of the first and second connectors having the resilient member to retract.

15. An electromagnetic induction-type connector comprising:

a first connector on a first member which includes a first core member; and a second connector on a second member adapted to be brought into proximity to the first member, which includes a second core member for producing an induction electromotive force in cooperation with the first coil member;

an elastic member provided at the first connector for allowing the first core member to retract upon contact between the first and second connectors; and a fixing member for fixing the elastic member to the first member, wherein electric power or a signal is transmitted between the first connector and the second connector by mutual induction effect when the second member is brought into proximity to the first member.

16. The electromagnetic induction-type connector according to claim 15, wherein the elastic member is watertightly connected to the fixing member, and the elastic member includes a waterproof covering member which watertightly covers the first core member.

17. The electromagnetic induction-type connector according to claim 15, wherein a waterproof portion is provided on the first core member, and the elastic member is watertightly connected to the waterproof portion.

18. The electromagnetic induction-type connector according to claim 1, wherein the shock-absorbing resilient member is provided at an inner end portion of the second fitting portion.

19. The electromagnetic induction-type connector according to claim 1, wherein the second fitting portion has a substantially trapezoid-shaped cross-section.

* * * * *